US011879254B2

(12) United States Patent
Sawada et al.

(10) Patent No.: US 11,879,254 B2
(45) Date of Patent: Jan. 23, 2024

(54) SECURING MEMBER AND WALL STRUCTURE

(71) Applicant: NICHIHA CORPORATION, Nagoya (JP)

(72) Inventors: Yohei Sawada, Nagoya (JP); Kohei Hamada, Nagoya (JP)

(73) Assignee: NICHIHA CORPORATION, Nagoya (JP)

( * ) Notice: Subject to any disclaimer, the term of this patent is extended or adjusted under 35 U.S.C. 154(b) by 0 days.

(21) Appl. No.: 17/574,456

(22) Filed: Jan. 12, 2022

(65) Prior Publication Data

US 2022/0136255 A1 May 5, 2022

Related U.S. Application Data

(63) Continuation of application No. PCT/JP2020/036903, filed on Sep. 29, 2020.

(30) Foreign Application Priority Data

Sep. 30, 2019 (JP) ..... 2019-179209
Jun. 18, 2020 (JP) ..... 2020-104976

(51) Int. Cl.
*E04F 13/08* (2006.01)

(52) U.S. Cl.
CPC ..... *E04F 13/0846* (2013.01); *E04F 13/0826* (2013.01)

(58) Field of Classification Search
CPC ..... E04F 13/0846; E04F 13/0801; E04F 13/0826; E04B 1/40; E04B 2001/405
See application file for complete search history.

(56) References Cited

U.S. PATENT DOCUMENTS 6,315,489 B1 * 11/2001 Watanabe ..... E04F 13/0846 248/220.21
6,402,419 B1 * 6/2002 Watanabe ..... E04F 13/0846 403/381

(Continued)

FOREIGN PATENT DOCUMENTS

JP 2000-45484 A 2/2000
JP 1062872 S 3/2000

(Continued)

OTHER PUBLICATIONS

International Search Report for International Application No. PCT/JP2020/036903 dated Dec. 15, 2020 (9 sheets).

(Continued)

*Primary Examiner* — Theodore V Adamos
(74) *Attorney, Agent, or Firm* — Kratz, Quintos & Hanson, LLP

(57) ABSTRACT

Provided are a wall structure that has high strength and can stably support a wall material, and a securing member that is used in the wall structure. The wall structure includes a securing member 10 that fixes a wall material 2 to a building frame 8. The securing member 10 includes a substrate portion 15, a bulging portion 30 that bulges from the substrate portion 15 and extends in a left-fight direction, a contact surface 31 that comes into contact with the rear surface of the wall material 2, and a locking portion 13 that engages the wall material 2.

16 Claims, 19 Drawing Sheets

(56) References Cited

U.S. PATENT DOCUMENTS

| | | | | |
|---|---|---|---|---|
| 6,615,560 | B2 * | 9/2003 | Ito | E04F 13/0846 248/220.21 |
| 6,688,060 | B2 | 2/2004 | Sawada | |
| 6,830,405 | B2 * | 12/2004 | Watanabe | E04F 13/0846 403/14 |
| D591,585 | S * | 5/2009 | Hikai | E04F 13/007 D8/382 |
| D610,899 | S | 3/2010 | Hikai | |
| D620,784 | S | 8/2010 | Hikai | |
| D656,393 | S * | 3/2012 | Honda | E04F 13/0846 D8/382 |
| 9,470,000 | B1 * | 10/2016 | Ochi | E04F 13/007 |
| D808,784 | S * | 1/2018 | Suzuki | E04F 13/0846 D8/382 |
| D848,249 | S * | 5/2019 | Suzuki | E04F 13/0846 D8/384 |
| 2001/0045075 | A1 * | 11/2001 | Watanabe | E04F 13/0826 52/715 |
| 2005/0102944 | A1 * | 5/2005 | Hikai | E04F 13/0846 52/511 |
| 2006/0272261 | A1 * | 12/2006 | Ito | E04F 13/0846 52/586.1 |
| 2008/0053024 | A1 * | 3/2008 | Ito | E04F 13/007 52/718.01 |
| 2010/0122506 | A1 * | 5/2010 | Kato | E04F 13/0846 52/483.1 |
| 2012/0241574 | A1 | 9/2012 | Uota | |
| 2017/0268237 | A1 * | 9/2017 | Suzuki | E04F 13/0832 |
| 2018/0016797 | A1 * | 1/2018 | Suzuki | E04B 1/40 |

FOREIGN PATENT DOCUMENTS

| | | | |
|---|---|---|---|
| JP | 1128615 | S | 12/2001 |
| JP | 2003-20772 | A | 1/2003 |
| JP | 2004-339714 | A | 12/2004 |
| JP | 2005-016060 | A | 1/2005 |
| JP | 2005-133504 | A | 5/2005 |
| JP | 2006-083647 | A | 3/2006 |
| JP | 2006-257719 | A | 9/2006 |
| JP | 1288420 | S | 12/2006 |
| JP | 2007-321510 | A | 12/2007 |
| JP | 1426252 | S | 10/2011 |
| JP | 1445756 | S | 7/2012 |
| JP | 2013-245513 | A | 12/2013 |
| JP | 2014-001535 | A | 1/2014 |
| JP | 2015-021353 | A | 2/2015 |
| JP | 2015-074947 | A | 4/2015 |
| JP | 2015-194036 | A | 11/2015 |
| JP | 2016-102361 | A | 6/2016 |
| JP | 2016-125281 | A | 7/2016 |
| JP | 1584637 | S | 8/2017 |
| JP | 2017-166227 | A | 9/2017 |
| JP | 2017-166228 | A | 9/2017 |
| JP | 1585344 | S | 9/2017 |
| JP | 2018-127864 | A | 8/2018 |
| JP | 2018-150768 | A | 9/2018 |

OTHER PUBLICATIONS

U.S. Appl. No. 29/752,937, co-pending application, titled Wall Board Attachment Lug, filed Sep. 29, 2020, first named inventor Yohei Sawada, assignee Nichiha Corporation.

U.S. Appl. No. 29/752,946, co-pending application, titled Wall Board Attachment Lug, filed Sep. 29, 2020, first named inventor Kohei Hamada, assignee Nichiha Corporation.

EP Communication dated Apr. 24, 2023 for EP Patent Application No. 20871422 and Supplementary European Search Report for EP Patent Application No. 20871422 dated Apr. 14, 2023 (7 sheets).

* cited by examiner

SECURING MEMBER AND WALL STRUCTURE

TECHNICAL FIELD

The present invention relates to a securing member and a wall structure.

BACKGROUND ART

A securing member for fixing a wall material has been used in a building frame such as a wooden framework, a timber frame, RC (reinforced concrete), or a steel frame. A conventional securing member for a wall material has been disclosed in Patent Literatures 1 and 2.

Patent Literature 1 discloses a securing member including a substrate portion fixed to a building frame, a contact surface that comes into contact with a rear surface of a wall material, an upper engagement portion that engages an upper wall material, and a lower engagement portion that engages a lower wall material.

Patent Literature 2 discloses an elongated securing member manufactured through bending. The strength of this securing member is large.

CITATION LIST

Patent Literature

[PLT 1]
Patent: JP 2017-166227A
[PTL 2]
Patent: JP 2015-74947A

SUMMARY OF INVENTION

Technical Problem

The securing members disclosed in Patent Documents 1 and 2 have excellent strength. However, in the case of an earthquake, strong wind, or the like, a large load is further applied to the securing member in addition to the load that is normally applied thereto by the wall material.

The present invention was conceived based on the foregoing conventional circumstances, and an object thereof is to provide a securing member that has a high strength and can stably fix a wall material, and a wall structure using the securing member.

Solution to Problem

A first aspect of the present invention is a wall structure including a building frame of a building, multiple wall materials, and securing members for attaching the wall materials to the building frame. In the wall structure, the securing member includes a substrate portion with a rear surface that comes into contact with the building frame, a bulging portion that bulges from the substrate portion in a direction from a rear surface to a front surface of the substrate portion and extends in a longitudinal direction of the securing member, a contact surface that is provided on the bulging portion and comes into contact with a rear surface of the wall material, a locking portion that extends in the longitudinal direction of the securing member and protrudes from the bulging portion in a direction from the rear surface to the front surface of the substrate portion, an end-side fixing portion that is provided at a position biased toward one end from the center of the locking portion in the longitudinal direction, and in which at least both sides in the longitudinal direction and the locking portion side are surrounded by the bulging portion, and an inner-side bulging portion that forms a portion of the bulging portion, is located on a side toward the center of the locking portion in the longitudinal direction with respect to the end-side fixing portion, and has a shape in which a side opposite to a side adjacent to the end-side fixing portion is inclined toward the locking portion such that the width in the longitudinal direction increases toward the locking portion. One end side of the securing member is fixed to the building frame at the end-side fixing portion, and another end side supports the wall material using the locking portion in a state of not being fixed to the building frame.

In the wall structure of the first aspect, at least both sides in the longitudinal direction and the locking portion side of the end-side fixing portion of the securing member are surrounded by the bulging portion, and therefore the strength near the end-side fixing portion is large and deformation is not likely to occur.

Also, since the inner-side bulging portion has a shape in which a side portion on a side opposite to the end-side fixing portion is inclined such that the width in the longitudinal direction increases toward the locking portion, when a load is applied to the inner-side bulging portion, the load tends to be dispersed and the vicinity of the inner-side bulging portion is not likely to deform.

In this case, since the end-side fixing portion and the vicinity of the inner-side bulging portion have large strengths are not likely to deform, the wall material can be stably fixed even if the end-side fixing portion is used to fix the wall material to the building frame. Accordingly, the wall material can be fixed in a state of being fixed to the building frame using one end-side fixing portion of the securing member and not being fixed by the other end-side fixing portion.

A second aspect of the present invention is a fixing tool that fixes a wall material to a building frame of a building. The securing member is a securing member including: a substrate portion with a rear surface that comes into contact with the building frame; a bulging portion that bulges from the substrate portion in a direction from a rear surface to a front surface of the substrate portion and extends in a longitudinal direction; a locking portion that extends in the longitudinal direction of the securing member and protrudes from the bulging portion in a direction from the rear surface to the front surface of the substrate portion; an end-side fixing portion that is provided at a position biased toward one end from the center of the locking portion in the longitudinal direction, and in which at least both sides in the longitudinal direction and the locking portion side are surrounded by the bulging portion; an inner-side bulging portion that forms a portion of the bulging portion surrounding the end-side fixing portion, includes an inner-side contact surface for coming into contact with the wall material, and is located on a side toward the center of the locking portion in the longitudinal direction with respect to the end-side fixing portion; and an end-side bulging portion that forms a portion of the bulging portion surrounding the end-side fixing portion, includes an end-side contact surface for coming into contact with the wall material, and is located on a side opposite to the inner-side bulging portion in the longitudinal direction with respect to the end-side fixing portion. The width in the longitudinal direction of the inner-side contact surface is greater than the width in the longitudinal direction of the end-side contact surface.

In the securing member of the second aspect, at least both sides in the longitudinal direction and the locking portion side of the end-side fixing portion are surrounded by the bulging portion, and therefore the strength near the end-side fixing portion is large and deformation is not likely to occur. Also, the width in the longitudinal direction of the inner-side contact surface is longer than the width in the longitudinal direction of the end-side contact surface. For this reason, if the wall material is fixed to the building frame with the end-side fixing portion, even if a large load is applied to the end-side fixing portion, the strength near the end-side fixing portion is large and therefore the end-side fixing portion is not likely to deform and can support a large load. Also, since the width in the longitudinal direction of the inner-side contact surface is longer than the width in the longitudinal direction of the end-side contact surface, the strength near the inner-side contact surface is large, and therefore the securing member is not likely to deform and the wall material can be stably fixed.

In a securing member according to a third aspect of the present invention, it is preferable that in the shape of the inner-side bulging portion, a side portion on a side opposite to the side adjacent to the end-side fixing portion is inclined such that the width in the longitudinal direction of the inner-side contact surface increases toward the locking portion.

According to this securing member, the side portion of the inner-side bulging portion is inclined, and therefore the load applied to the inner-side bulging portion is dispersed. Also, in the locking portion arranged below the inner-side bulging portion at which the load is likely to be concentrated, the load is dispersed due to the inclination of the side portion of the upper inner-side bulging portion and the securing member is not likely to deform, and therefore the wall material can be stably fixed.

A fourth aspect of the present invention is a fixing tool that fixes a wall material to a building frame of a building. The securing member is a securing member including: a substrate portion with a rear surface that comes into contact with the building frame; a bulging portion that bulges from the substrate portion in a direction from a rear surface to a front surface of the substrate portion and extends in a longitudinal direction; a locking portion that extends in the longitudinal direction of the securing member and protrudes from the bulging portion in a direction from the rear surface to the front surface of the substrate portion; a contact surface that is provided on the bulging portion and comes into contact with the wall material; an end-side fixing portion that is provided at a position biased toward one end side from the center of the locking portion in the longitudinal direction, and in which at least both sides in the longitudinal direction and the locking portion side are surrounded by the bulging portion; an inner-side bulging portion that forms a portion of the bulging portion surrounding the end-side fixing portion, and is located on a side toward the center of the locking portion in the longitudinal direction with respect to the end-side fixing portion; and an end-side bulging portion that forms a portion of the bulging portion surrounding the end-side fixing portion and is located on a side opposite to the inner-side bulging portion in the longitudinal direction with respect to the end-side fixing portion. In the longitudinal direction, the width of the inner-side bulging portion is greater than the width of the end-side bulging portion. In the inner-side bulging portion, a side portion on a side opposite to a side adjacent to the end-side fixing portion is inclined such that the width in the longitudinal direction of the inner-side bulging portion increases toward the locking portion. The length from the substrate portion to the contact surface is longer than the length from the substrate portion to the peak portion of the inner-side bulging portion. The securing member includes a connection surface that connects a side portion on the locking portion side of the inner-side bulging portion and a side portion on the inner-side bulging portion side of the contact surface.

In the securing member of the fourth aspect, the end-side fixing portion is surrounded by the bulging portion, and therefore the strength near the end-side fixing portion is large and deformation is not likely to occur. Also, since the width in the longitudinal direction of the inner-side bulging portion is longer than the width in the longitudinal direction of the end-side bulging portion, the range in which the securing member is reinforced by the inner-side bulging portion is wider, and therefore the strength of the securing member near the inner-side bulging portion is large and deformation is not likely to occur.

Also, if the wall material is fixed at the end-side fixing portion, the strength near the end-side fixing portion is large and deformation is not likely to occur even if a large load is applied to the end-side fixing portion, and therefore a large load can be supported. Furthermore, since the width in the longitudinal direction of the inner-side bulging portion is long, the securing member is not likely to deform, and the wall material can be stably fixed.

Also, since the length from the substrate portion to the contact surface is longer than the length from the substrate portion to the peak portion of the inner-side bulging portion and the connection surface that smoothly connects the inner-side bulging portion and the contact surface is included, when the above-described wall material is fixed, the lower-side end portion can be placed on the connection surface and can be moved over the connection surface, and the lower-side end surface of the upper-side wall material can be suitably engaged to the securing member.

In the securing member serving as the fifth aspect of the present invention, it is preferable that a central fixing portion that is adjacent to the side portion of the inner-side bulging portion on the side opposite to the end-side fixing portion is provided.

According to this securing member, if an intermediate portion of the wall material is engaged with the securing member, the securing member can be fixed to the building frame using the central fixing portion, and therefore the load applied to the securing member can be dispersed to the left and right and the wall material can be stably fixed.

In the securing member serving as the sixth aspect of the present invention, it is preferable that an upper bulging portion that is adjacent to the end-side fixing portion is provided above the end-side fixing portion.

According to this securing member, the end-side fixing portion is surrounded on four sides by the bulging portion including the upper bulging portion, and therefore the strength near the end-side fixing portion can be further improved, and the wall material can be stably fixed.

In the securing member serving as a seventh aspect of the present invention, it is preferable that a support piece that is provided on the locking portion and extends in a direction from the rear surface to the front surface of the substrate portion, an upper engagement portion that extends in a direction away from the bulging portion on a leading end of the support piece on the end-side fixing portion side with respect to the support piece, and a lower engagement portion that extends in a direction away from the bulging portion on a leading end of the support piece on a side opposite to the end-side fixing portion side with respect to the support piece are arranged.

According to this securing member, the upper engagement portion can engage the lower-side end portion of the upper wall material and the lower engagement portion can engage the upper-side end portion of the lower wall material.

In a securing member serving as an eighth aspect of the present invention, it is preferable that the upper engagement portion is arranged on both sides in the longitudinal direction of the locking portion.

The load applied to the upper engagement portion is greater than the load applied to the lower engagement portion, and according to this securing member, the engagement portion that is the closest to the end-side fixing portion fixed to the building frame is the upper engagement portion arranged on the end side. Since the upper engagement portion is near the end-side fixing portion, the load applied to the upper engagement portion can be efficiently transmitted to the end-side fixing portion fixed to the building frame, and therefore the attachment strength with which the wall material is fixed to the building frame can be improved, and the wall material can be stably fixed.

In the securing member serving as a ninth aspect of the present invention, it is preferable that the end portion of the inner-side bulging portion on the side opposite to the end-side fixing portion in the longitudinal direction is not at a position that matches in the longitudinal direction with a boundary between the vicinity of the upper engagement portion and the vicinity of the lower engagement portion that are the closest to the end portion.

The load is likely to be concentrated at the end portion of the inner-side bulging portion. The load is likely to be concentrated also near the boundary between the upper engagement portion and the lower engagement portion. According to this securing member, the end portion of the inner-side bulging portion and the boundary between the upper engagement portion and the lower engagement portion at which the loads are likely to be concentrated are not located at matching positions. Accordingly, the positions at which the loads are likely to be concentrated in the securing member are dispersed, and the loads are not concentrated at one point, and therefore the securing member is less likely to deform, and the wall material can be stably fixed.

In the securing member serving as a tenth aspect of the present invention, it is preferable that an uneven surface is included on a front surface of at least one of the end-side fixing portion and the central fixing portion.

According to this securing member, an uneven surface is included, and therefore the leading end of a fastener such as a screw or a nail is less likely to slip, and the workability at the time of fixing the securing member to the building frame is improved.

Advantageous Effects of Invention

According to the wall structure and the securing member of the present invention, it is possible to provide a wall structure that has high strength and can stably hold a wall material, and a securing member to be used in the wall structure.

DESCRIPTION OF EMBODIMENTS

Figure 1:
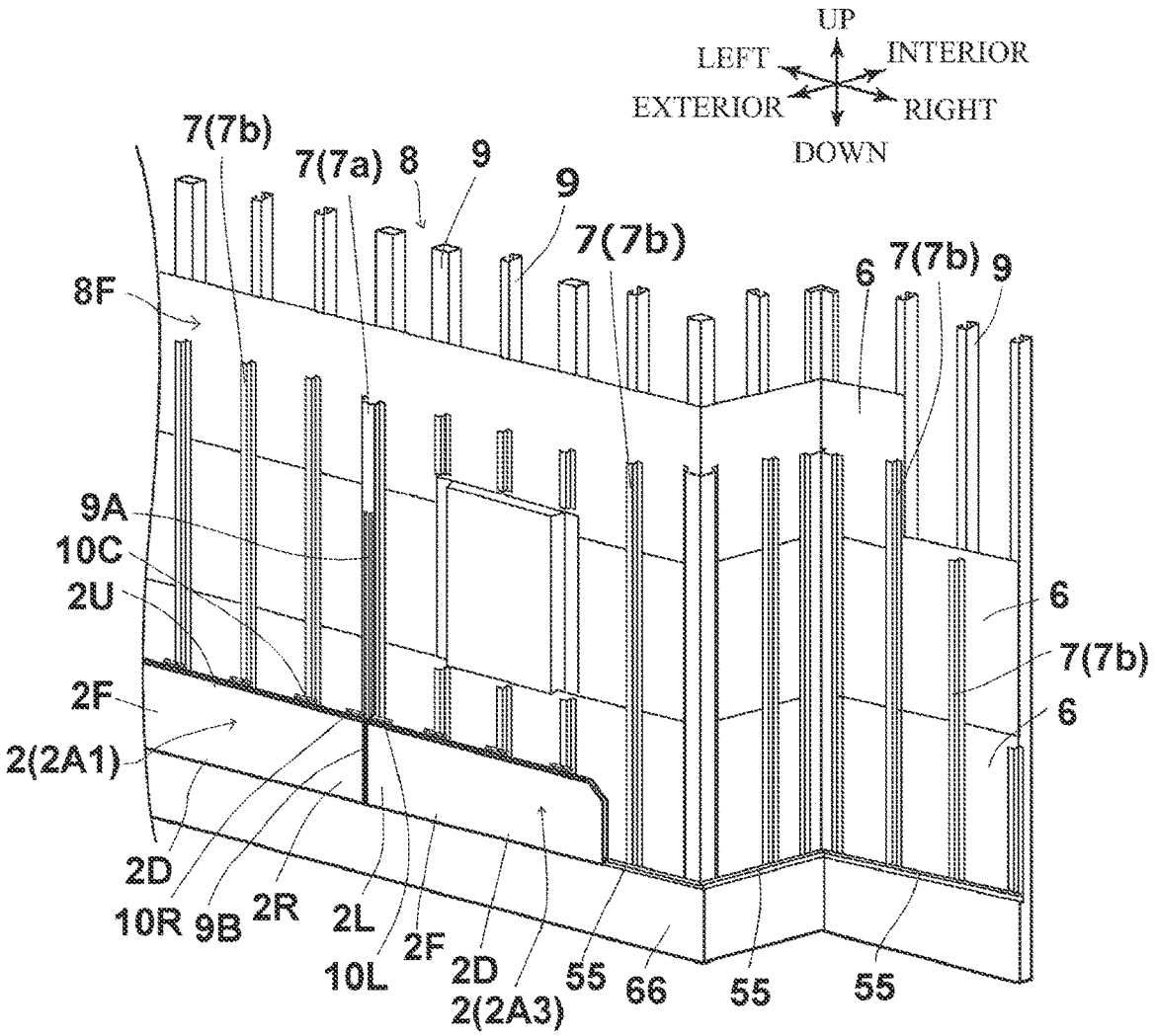
FIG. 1 is a perspective view schematically showing a wall structure of a first embodiment of the present invention.

Hereinafter, specific embodiments of the securing member of the present invention will be described with reference to the drawings. In FIG. 1, the upward direction perpendicular to the ground surface is shown as up, and the downward direction perpendicular to the ground surface is shown as down. Also, in the direction from the exterior to the interior in FIG. 1, a horizontally leftward direction is shown as left, and a horizontally rightward direction is shown as right. Also, the directions shown in FIG. 2 and onward correspond to those of FIG. 1.

First Embodiment

FIG. 1 shows an example of a wall structure. This wall structure is obtained by attaching multiple exterior wall members 2 to a building frame 8 forming a building such as a residence, a facility, or a warehouse. The exterior wall members 2 are an example of wall materials. The exterior wall members 2 are wall materials that have high strength and rigidity and form an exterior wall of the building. Note that the wall material is not limited to an exterior wall member, and for example, may also be an interior material or the like.

The building frame 8 is constructed using a steel frame. The building frame 8 is constructed using multiple structural members. The structural member includes multiple columns 9 that are arranged side by side with a predetermined gap in the left-right direction, as well as auxiliary members such as studs arranged between the columns 9, support members 7 (7*a*, 7*b*) for fixing the exterior wall members 2 to the building frame, and the like. The support member 7 is fixed by screws or the like (not shown) to the outer surfaces facing the exterior direction of the columns 9. In the present embodiment, as one example, a case will be described in which the exterior wall members 2 are fixed to the support member 7, which is one structural member, but the exterior wall members 2 may also be fixed to other structural members such as columns 9.

Waterproofing sheets 6 are laid between the column members 9 and the support members 7 to cover the outer surface 8F of the building frame 8. Note that the building frame 8 is not limited to the configuration of the present embodiment and may also be constructed using wood post and beam construction, timber frame construction, or the like. The building frame 8 may also be, for example, a frame made of reinforced concrete, bricks, or the like.

Figure 2:
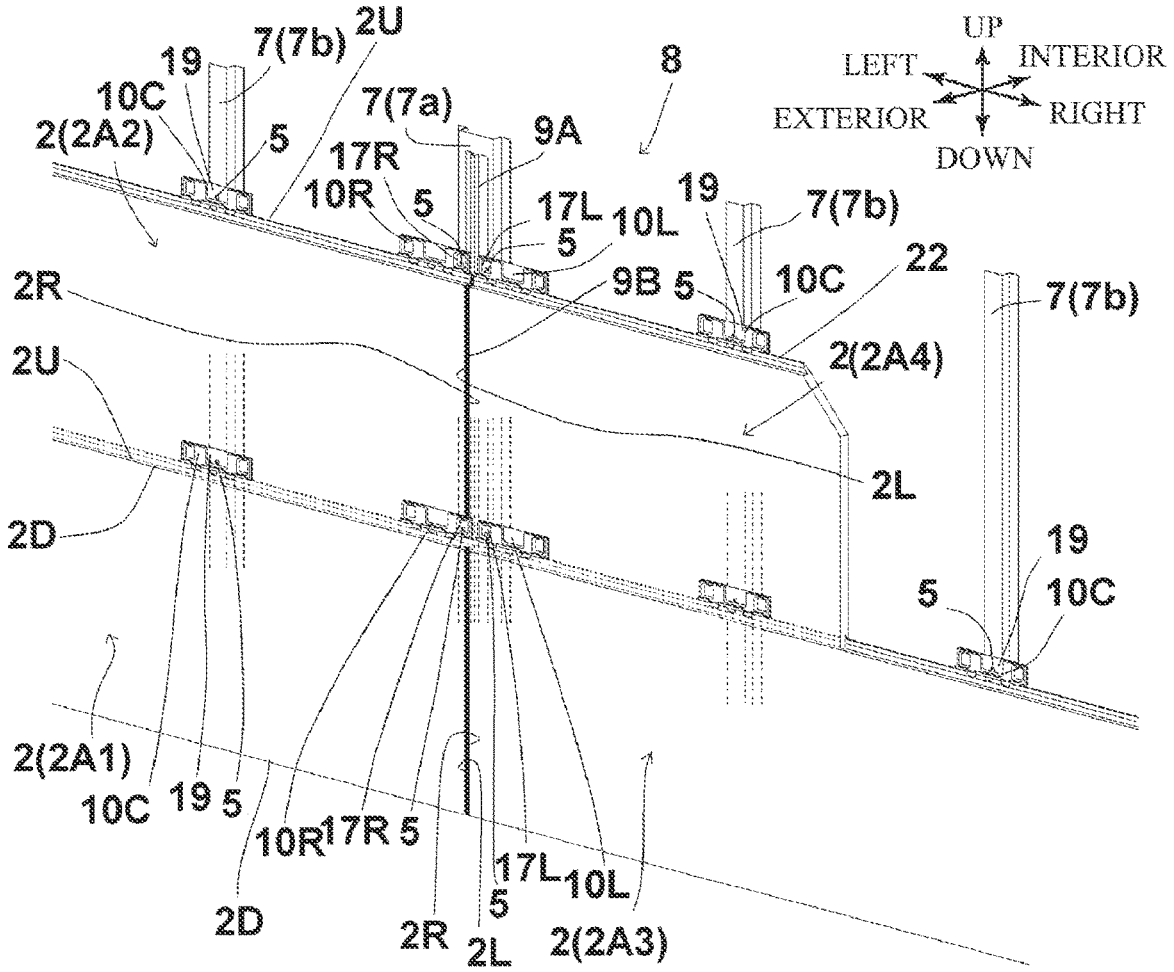
FIG. 2 is a perspective view showing a relative positional relationship (two-side shiplap) between a wall material and a securing member that are coupled through shiplap in the first embodiment.
Figure 3:
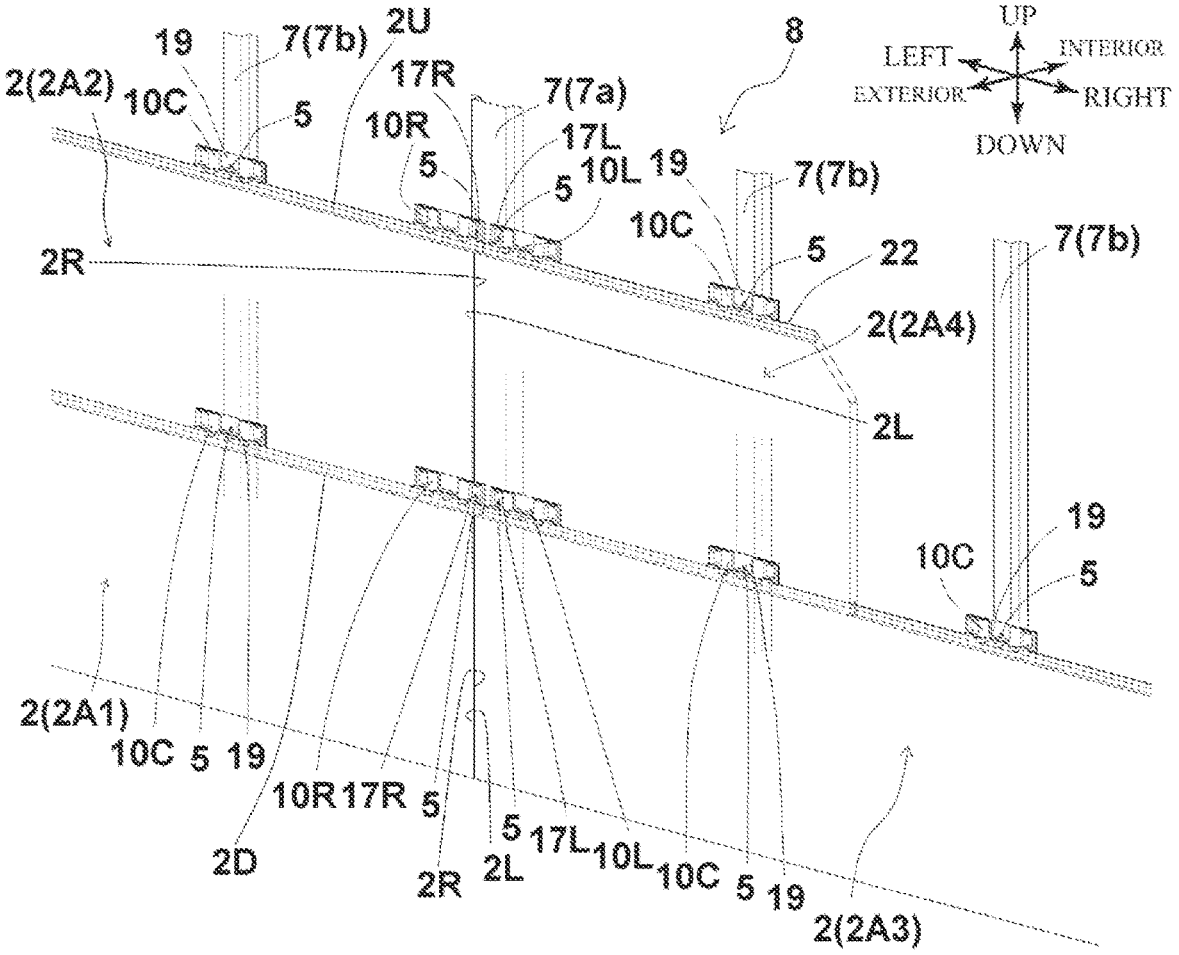
FIG. 3 is a perspective view showing a relative positional relationship (four-side shiplap) between a wall material and a securing member that are coupled through shiplap in the first embodiment.

As shown in FIGS. 1 to 3, the exterior wall members 2 are quadrilateral, or more specifically, approximately rectangular plate materials that are elongated in the left-right direction. In the present embodiment, the exterior wall member 2 is composed of a ceramic material including cement. Note that the material of the exterior wall member 2 is not limited to the above description, and for example, a metal-based material, a wood-based material, a resin-based material, or the like can be selected as appropriate.

The exterior wall members 2 illustrated in the present embodiment have a length in the longitudinal direction that is about 900 mm to about 3030 mm, and a length in the short-side direction that is about 450 mm to about 1000 mm.

FIG. 2 shows a method for attaching an exterior wall member 2 with a two-side shiplap shape. The exterior wall member 2 with a two-side shiplap shape has a shape in which joining portions (tongue portions) for joining with other exterior wall members 2 adjacent thereto in the up-down direction are included on an upper-side end portion 2U and a lowerside end portion 2D of the exterior wall member 2, and joining portions for joining with other exterior wall members 2 adjacent thereto in the left-right direction are not included on a left-side end portion 2L and a right-side end portion 2R.

Figure 4:
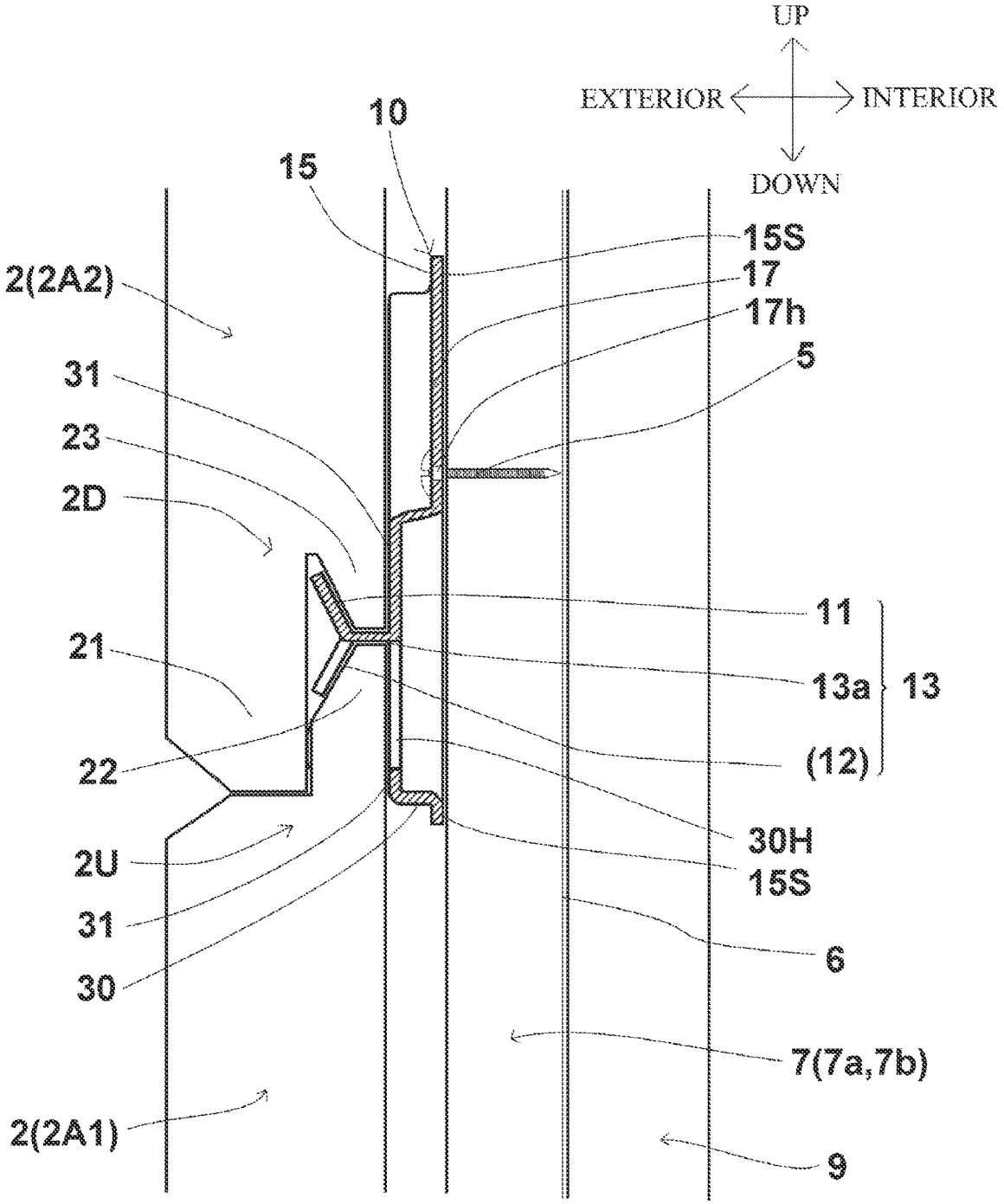
FIG. 4 is a cross-sectional view showing a vicinity of a joining portion between wall materials that are adjacent in the up-down direction in a constructed state in the first embodiment.

As shown in FIG. 4, the exterior wall members 2 that are vertically adjacent are joined due to lower tongue portions 22, which are joining portions provided on the upper-side end portions 2U, being engaged with upper tongue portions 21 and upper tongue engaging portions 23, which are joining portions provided on the lowerside end portions 2D of the exterior wall members 2.

As will be described later, a securing member 10 is arranged between the upper and lower exterior wall members 2, and the exterior wall members 2 are attached to the structural member by the securing member 10.

The lower tongue portion 22 is a portion that protrudes along the upperside end portion 2U of the exterior wall member 2. The upper tongue portion 21 is a portion at which the rear surface of the lower-side end portion 2D of the exterior wall member 2 is recessed so as to cover the external side of the lower tongue portion 22. Also, the upper tongue engaging portion 23 is a portion that engages with an upper engagement portion 11 of the later-described securing member 10. Normally, a sealing material (joint sealer) or the like is not used in the engaging portions of the upper tongue portion 21, the upper tongue engaging portion 23, and the lower tongue portion 22.

On the other hand, since a joining portion is not included on the left-side end portion 2L and the right-side end portion 2R of the exterior wall member 2, the exterior wall members 2 adjacent in the left-right direction are joined in a state in which a known hat joiner 9A shown in FIG. 2 and a joint sealer 9B such as a sealing material are interposed between the exterior wall members 2.

FIG. 3 shows a method for attaching an exterior wall member 2 with a so-called four-side shiplap shape. An exterior wall member 2 with a four-side shiplap shape includes joining portions (tongue portions) for joining to other exterior wall members 2 on the upper-side end portion 2U, the lowerside end portion 2D, the left-side end portion 2L, and the right-side end portion 2R of the exterior wall member 2.

The upper-side end portion 2U and the lower-side end portion 2D of the exterior wall member 2 include the upper tongue portion 21, the upper tongue engaging portion 23, and the lower tongue portion 22 serving as joining portions, similarly to the above-described exterior wall member 2 with a two-side shiplap shape.

The left-side end portion 2L and the right-side end portion 2R also include joining portions (not shown) for joining with other exterior wall members 2, similarly to the above-described upper and lower tongue portions 21 and 22. Normally, a known lateral shifting prevention metal fitting (not shown) for preventing positional misalignment in the horizontal direction of the exterior wall member 2 is attached between the exterior wall members 2 that are adjacent in the left-right direction.

The securing member 10 is for fixing the exterior wall member 2 to the building frame 8. In the present embodiment, the securing member 10 fixes the exterior wall member 2 to the building frame 8 by being fixed to a support member 7 serving as a structural member.

The securing member 10 is manufactured due to a plate of metal such as iron or stainless steel being subjected to punching, pressing, bending, or the like. Note that the material and manufacturing method of the securing member 10 are not limited to the description above, and types of materials other than metal and the manufacturing method can be selected as appropriate.

Figure 5:
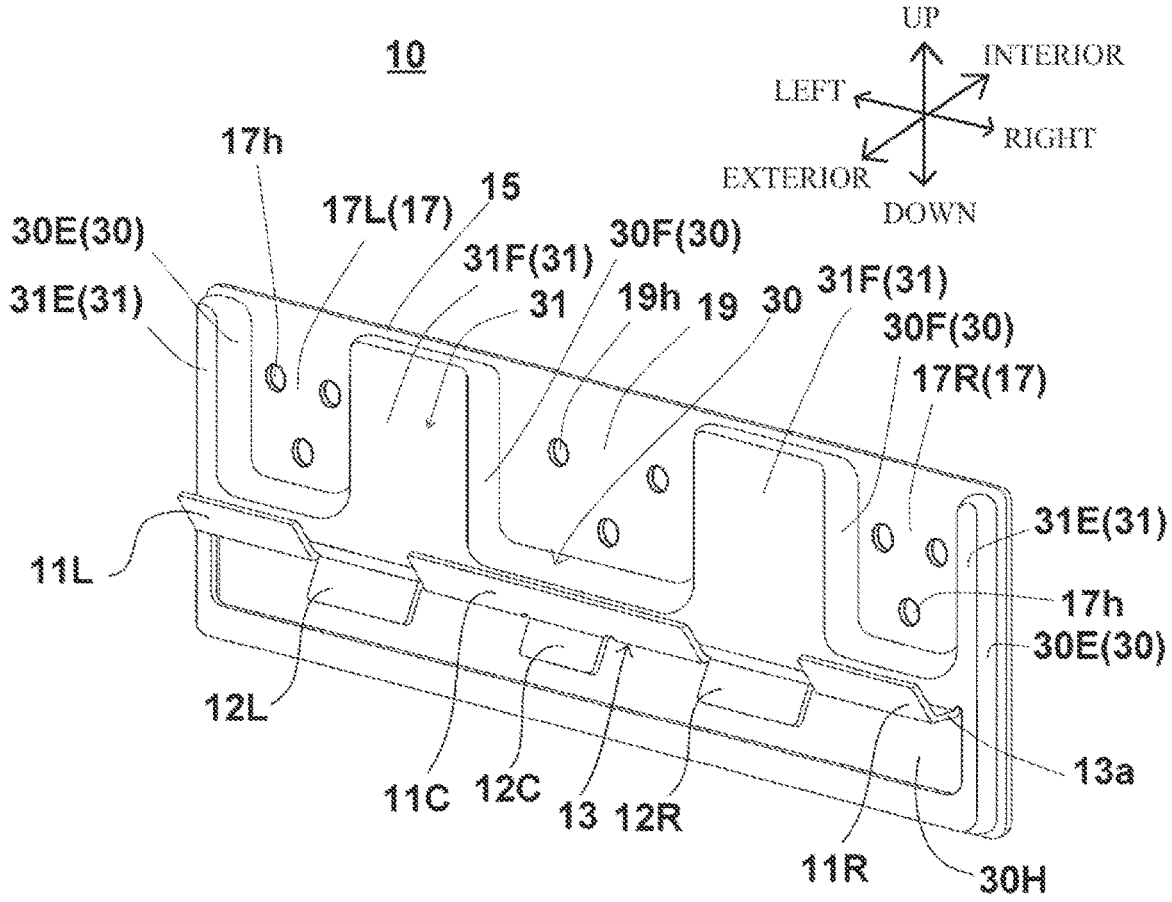
FIG. 5 is a perspective view schematically showing a securing member according to a first embodiment.
Figure 6:
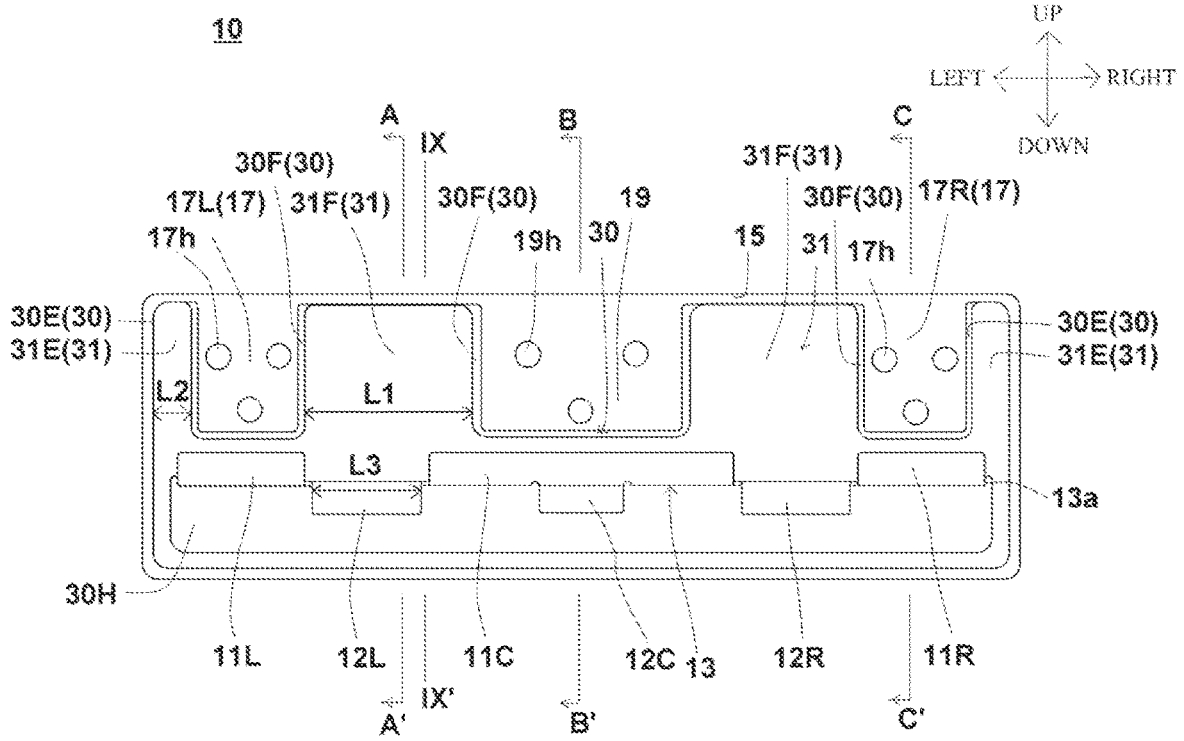
FIG. 6 is a front view schematically showing the securing member according to the first embodiment.

As shown in FIGS. 5, 6, and the like, the securing member 10 is a member with an approximately rectangular shape. The securing member 10 of the present embodiment for fixing the above-described exterior wall members 2 has a length in the longitudinal direction that is about 100 mm to about 200 mm, and a length in the short-side direction that is about 50 mm to about 100 mm.

As shown in FIG. 4, the securing member 10 is attached to each support member 7 using a screw 5 serving as a fastener. However, the attachment method is not limited to this configuration, and for example, the securing member 10 may also be attached using another fastener such as a nail or a rivet to the column 9 or the support member 7.

As shown in FIGS. 2, 3, and 4, in order to support the exterior wall member 2, the securing member 10 is attached such that the front side of the securing member 10 faces the exterior direction and the rear side faces the interior direction when fixed to the support member 7. At this time, the securing member 10 is attached such that the longitudinal direction of the securing member 10 is the left-right direction (horizontal direction). The securing member 10 is attached such that the short-side direction of the securing member 10 is the up-down direction (vertical direction).

[Configuration of Securing Member]

FIGS. 5 to 10 show the securing member of the first embodiment. The securing member 10 has a laterally-elongated approximately rectangular shape in which the width in the left-right direction of the securing member 10 is greater than the width in the up-down direction. Also, the securing member 10 has a shape with bilateral symmetry in the left-right direction using a center line B-B' as an axis. The securing member 10 of the present embodiment has a substrate portion 15 on which a bulging portion 30 is formed by subjecting a metal plate to pressing. The substrate portion 15 is the portion of the metal plate that was not subjected to pressing, and is formed on the peripheral edge portion of the securing member 10. That is, the substrate portion 15 includes an upper side portion and a lower side portion that are located on the upper and lower long side portions of the securing member 10, and a left side portion and a right side portion that are located on the left and right short side portions of the securing member 10. The upper side portion, the lower side portion, the left side portion, and the right side portion of the substrate portion 15 are connected by circular arc-shaped corner portions. Also, the securing member 10 includes a pair of end-side fixing portions 17 (17L, 17R) that are arranged on both end portions in the left-right direction of the securing member 10 and a central fixing portion 19 that is arranged at the central portion in the left-right direction of the securing member 10. The end-side fixing portions 17 and the central fixing portion 19 are the portions of the metal plate that were not subjected to pressing.

Figure 7:
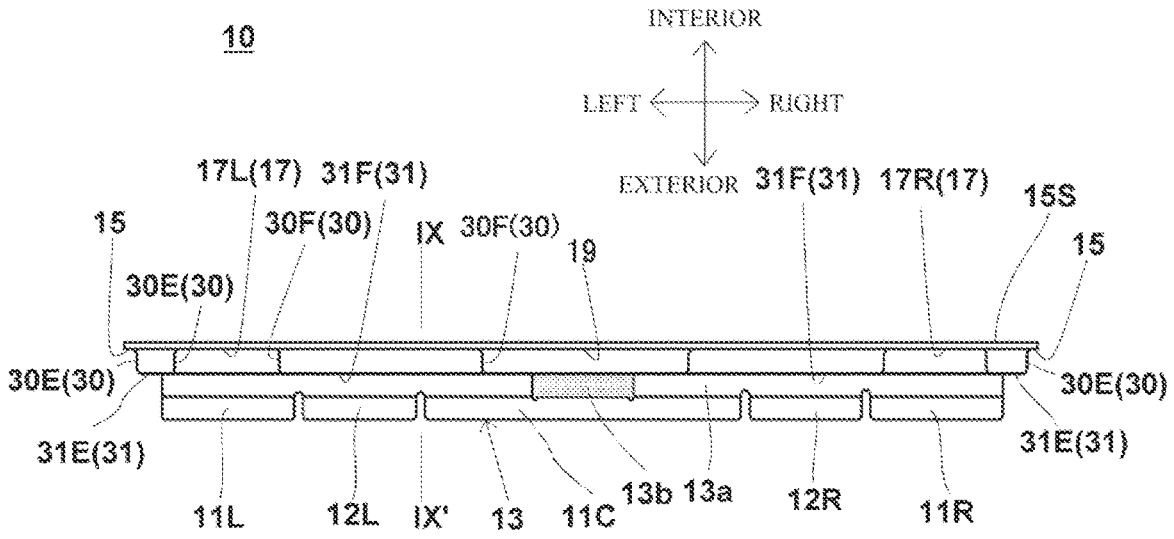
FIG. 7 is a plan view schematically showing the securing member according to the first embodiment.
Figure 8:
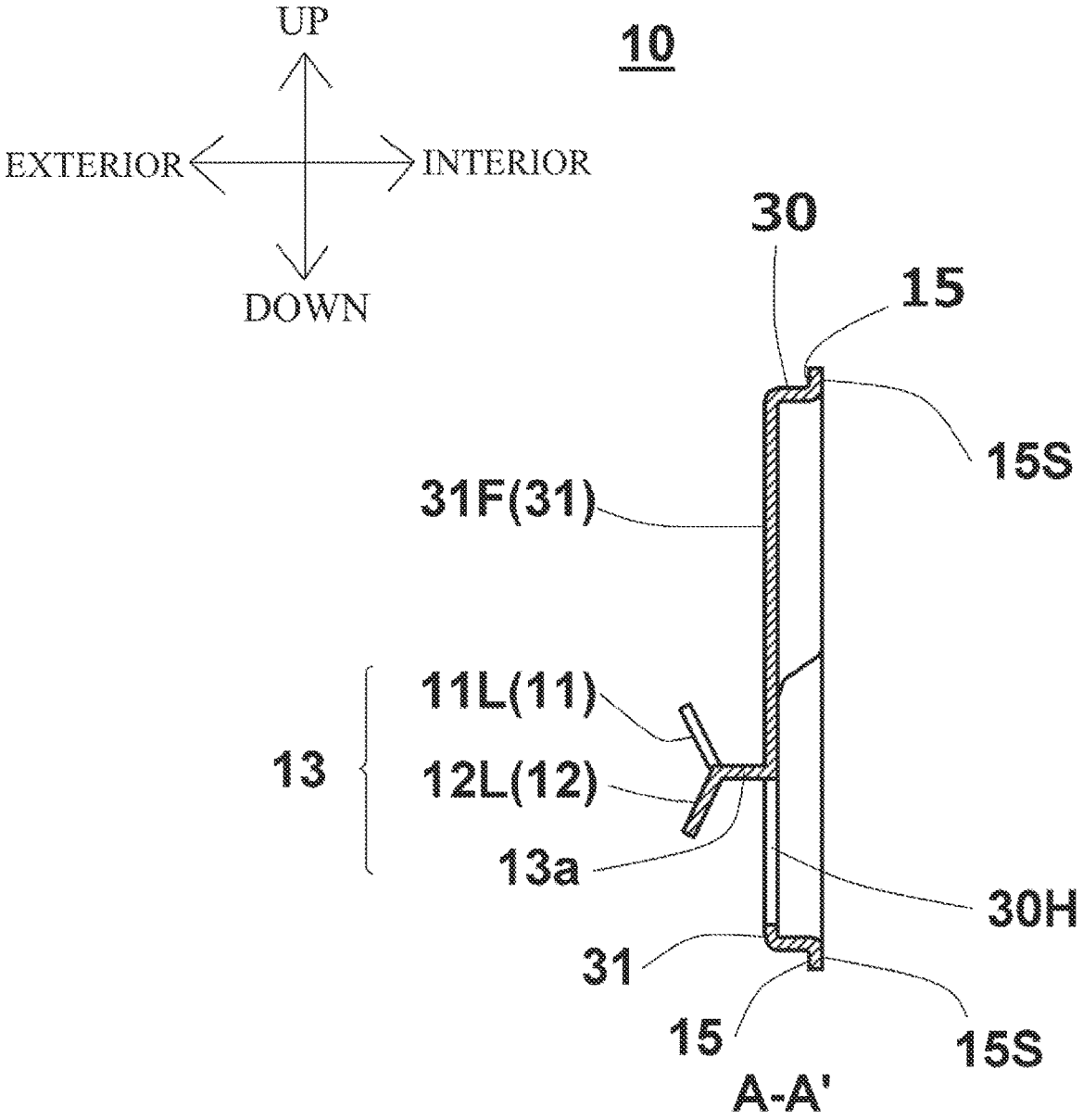
FIG. 8 is a cross-sectional view showing a cross section taken along line A-A' in FIG. 6.
Figure 9:
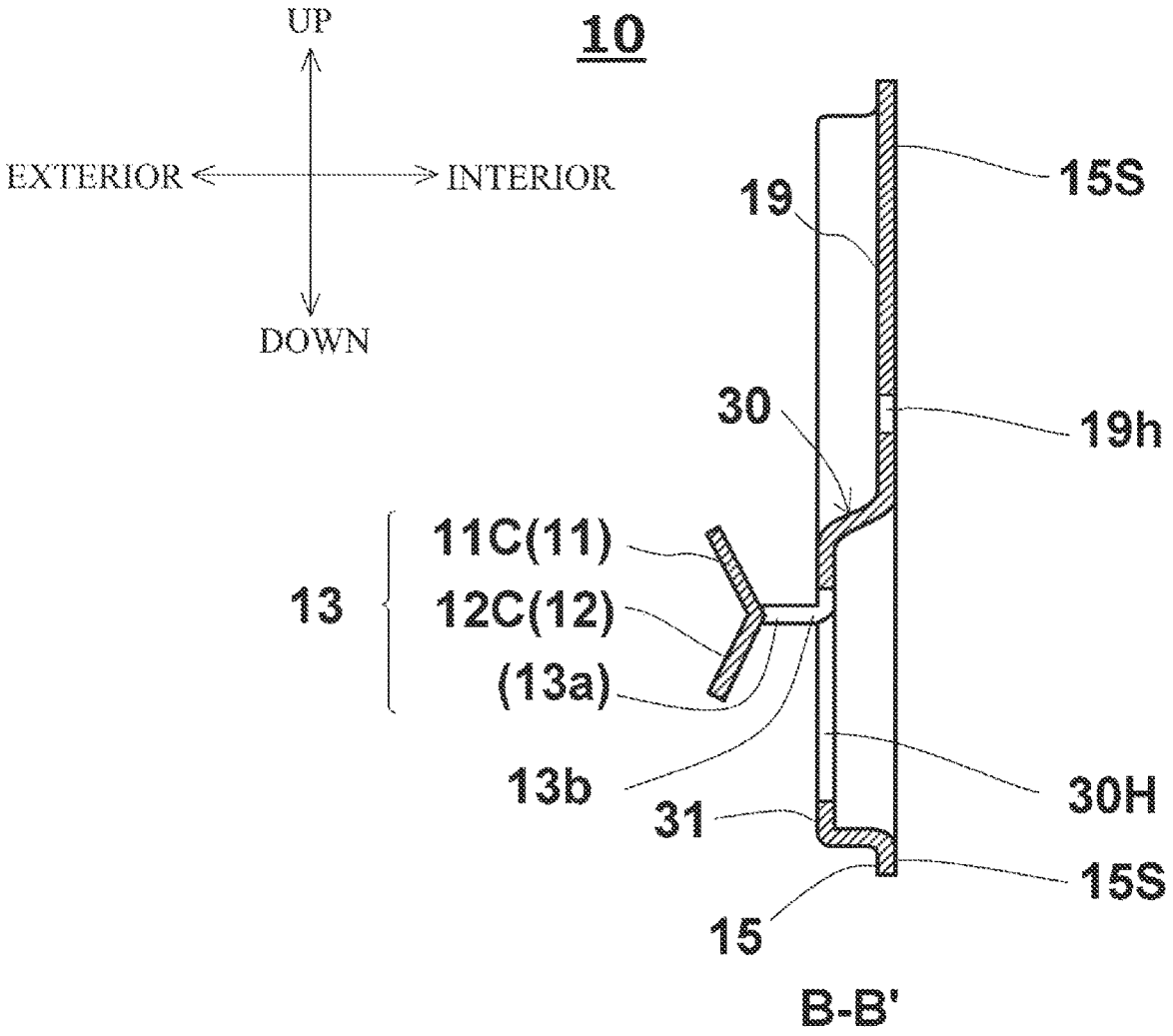
FIG. 9 is a cross-sectional view showing a cross section taken along line B-B' in FIG. 6.
Figure 10:
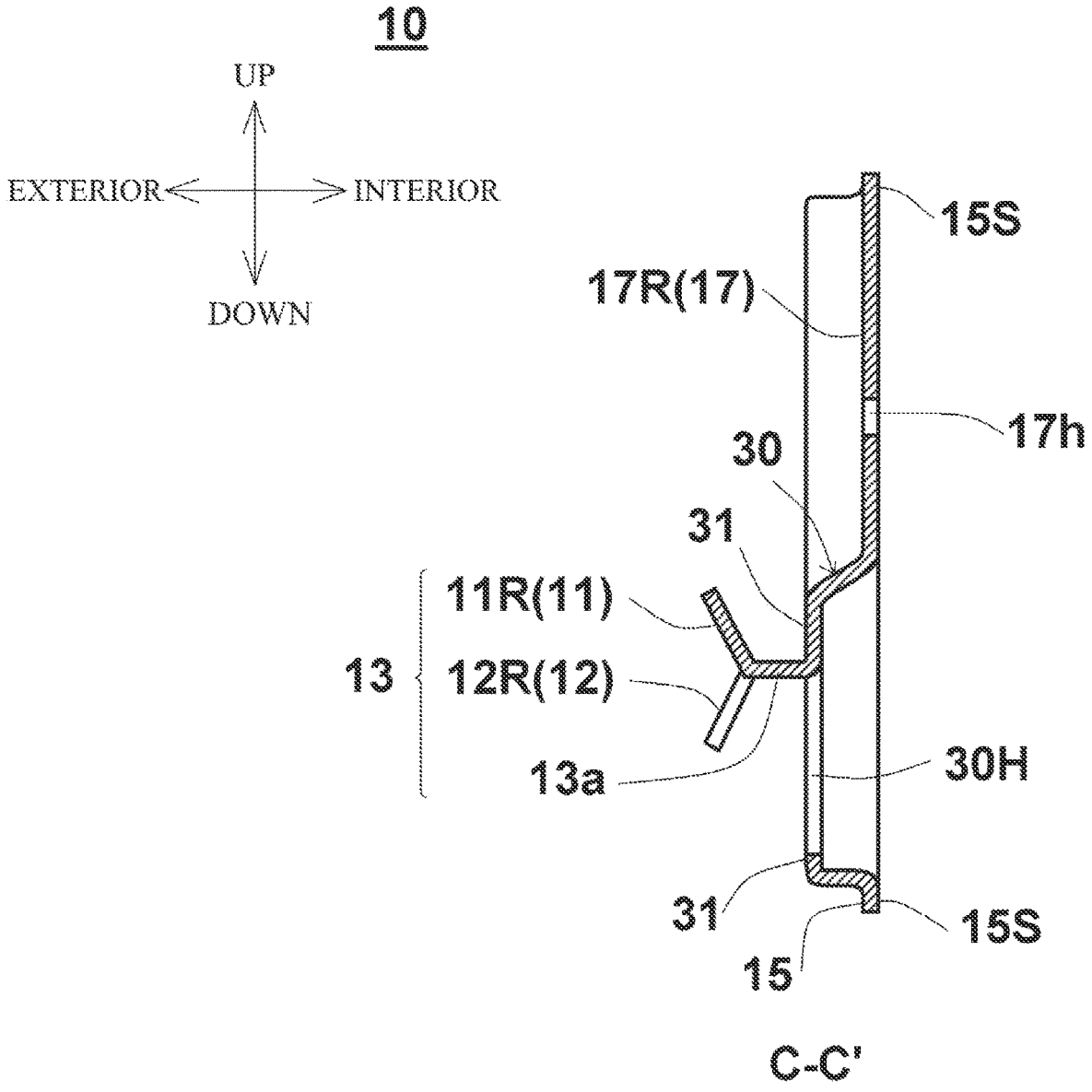
FIG. 10 is a cross-sectional view showing a cross section taken along line C-C' in FIG. 6.

As shown in FIG. 7, the rear surface of the substrate portion 15 is a reference surface 15S that comes into contact with a structural member such as a column 9 or a support member 7 when the securing member 10 is attached to the structural member. The rear surfaces of the end-side fixing portions 17 and the central fixing portion 19 match the reference surface 15S.

Normally, one of the left and right end-side fixing portions 17L and 17R and the central fixing portion 19 is used optionally according to the position at which the exterior wall member 2 is supported. That is, when the left-side end portion 2L side of the exterior wall member 2 is to be fixed, the left-side end-side fixing portion 17L is used as shown in the securing member 10L of FIGS. 2 and 3. Also, when the right-side end portion 2R of the exterior wall member 2 is to be fixed, the right-side end-side fixing portion 17R is used as shown in the securing member 10R. When a portion other than an end portion, such as the vicinity of the center of the exterior wall member 2, is to be fixed, the central fixing portion 19 is used as shown in the securing member 10C.

As shown in FIG. 6, the end-side fixing portions 17 are approximately U-shaped flat portions that are provided at positions shifted to the left and the right with respect to the center line B-B'. The end-side fixing portions 17 protrude downward from the upper side portion of the substrate portion 15 and form the same plane as the substrate portion 15.

The central fixing portion 19 is an approximately U-shaped flat portion provided on the center line B-B'. The central fixing portion 19 protrudes downward from the upper side portion of the substrate portion 15 and forms the same plane as the substrate portion 15.

The end-side fixing portions 17L and 17R and the central fixing portion 19 are each provided with three fixing holes 17*h* and 19*h*. The fixing holes 17*h* and 19*h* are for fixing the securing member 10 to the structural member due screws 5 being inserted therein. The three fixing holes 17*h* and 19*h* are arranged at positions of vertices of inverted triangular shapes in the end-side fixing portion 17 and the central fixing portion 19. The fixing holes 17*h* and 19*h* located on the lowermost side are located in the lower portions of the end-side fixing portions 17 and the central fixing portion 19. The other two fixing holes 17*h* and 19*h* are formed with bilateral symmetry with respect to a center line (the center line B-B' in the case of the central fixing portion 19) in the vertical direction passing through the fixing holes 17*h* and 19*h* below.

Note that the number, position, and the like of the fixing holes 17*h* and 19*h* are not limited to the present embodiment.

The bulging portion 30 protrudes toward the front of the securing member 10 from the substrate portion 15. The peak portion of the bulging portion 30 is a plane that is parallel to the substrate portion 15 and the reference surface 15S, and the plane is a contact surface 31.

The bulging portion 30 and the contact surface 31 are divided into an upper side and a lower side via a later-described support piece 13*a*. On the upper side of the bulging portion 30 and the contact surface 31, the bulging portion 30 includes, end-side bulging portions 30E on which end-side contact surfaces 31E are formed are included on both ends of the bulging portion 30. Also, the bulging portion 30 includes inner-side bulging portions 30F on which inner-side contact surfaces 31F are formed on the inner side of the two end-side bulging portions 30E, that is, toward the center line B-B'.

As shown in FIG. 6, the length L1 in the left-right direction of the left-side inner-side contact surface 31F is set to be longer than the length L2 in the left-right direction of the left-side end-side contact surface 31E. In the present embodiment, the length L1 is about 8 times the length L2, and is preferably about 6 to about 12 times the length L2.

Due to these configurations, the left-side end-side fixing portion 17L is located between the left-side end-side bulging portion 30E and the left-side inner-side bulging portion 30F, and the central fixing portion 19 is located between the pair of inner-side bulging portions 30F.

The same applies to the relationship between the lengths in the left-right direction of the right-side inner-side contact surface 31F and the right-side end-side contact surface 31E, which are arranged with bilateral symmetry.

In the present embodiment, on the upper side with respect to the support piece 13*a*, the surface area of the contact surface 31 including the inner-side contact surfaces 31F and the end-side contact surfaces 31E is about 1.5 times the total surface area of the end-side fixing portions 17 and the central fixing portion 19, and is preferably about 1.5 to 3 times the total surface area of the end-side fixing portions 17 and the central fixing portion 19.

Also, on the left side relative to the center line B-B', the length L1 in the left-right direction of the inner-side contact surface 31F is set to be longer than the length L3 in the left-right direction of the later-described engagement portion 12L arranged below the left-side inner-side contact surface 31F. Accordingly, as shown in FIG. 6, the inner-side contact surfaces 31F are formed spanning over the extended line of the boundary (IX-IX') between the lower engagement portion 12L and the upper engagement portion 11C and the extended line of the boundary between the upper engagement portion 11L and the lower engagement portion 12L.

In the present embodiment, the length L1 is about 1.5 times the length L3, and is preferably about 1.2 to about 3 times the length L3.

The relationship between the right-side inner-side contact surface 31F, the lower engagement portion 12R, and the upper engagement portions 11R and 11C with respect to the center line B-B' of the securing member 10 is also similar to the description above.

On the lower side of the end-side fixing portions 17 and the central fixing portion 19, a locking portion 13 and an opening 30H are formed on the bulging portion 30. Also, the locking portion 13 is formed over approximately the entire length in the longitudinal direction of the securing member 10 in the left-right direction.

The locking portion 13 is formed by cutting and raising one portion of the bulging portion 30 at the position corresponding to the opening 30H in the exterior direction. The opening 30H is formed in a state in which the contact surface 31 is left in the surrounding area. The locking portion 13 is composed of the support piece 13*a* protruding from the contact surface 31 and engagement portions 11 and 12 formed on the leading end of the support piece 13*a*.

The support piece 13*a* is formed so as to be approximately perpendicular to the contact surface 31 on the upper end of the opening 30H.

The engagement portions 11 and 12 are formed by bending the leading end of the support piece 13*a*. The upper engagement portions 11 are formed by bending the leading end of the support piece 13*a* obliquely upward, and the upper engagement portions 11L, 11C, and 11R are formed respectively on the left end, the center, and the right end of the securing member 10. In this manner, the upper engagement portions 11L and 11R are arranged on both ends in the left-right direction of the securing member 10.

The lower engagement portions 12 are formed by bending the leading end of the support piece 13*a* obliquely downward. The lower engagement portion 12L is formed between the upper engagement portion 11L and the upper engagement portion 11C, and the lower engagement portion 12R is formed between the upper engagement portion 11C and the upper engagement portion 11R.

The lower engagement portion 12C is formed at the center of the upper engagement portion 11C by cutting and raising the portion corresponding to the opening indicated by reference numeral 13*b* in FIG. 7 of the support piece 13*a*.

In the present embodiment, the surface area of the upper engagement portions 11 is about 2 times the surface area of the lower engagement portions 12, and is preferably about 1.5 to 4 times the surface area of the lower engagement portions 12.

Note that as with the present embodiment, forming the upper engagement portions 11L and 11R on both ends of the support piece 13*a* is preferable for increasing the surface areas of the upper engagement portions 11L and 11R, but the number, arrangement, and the like of the engagement portions 11 and 12 are not limited to the present embodiment.

The exterior wall members 2 are attached to the building frame 8 by the securing members 10 as follows. An exterior wall member 2 with a so-called two-side shiplap shape shown in FIG. 2 and an exterior wall member 2 with a so-called four-side shiplap shape shown in FIG. 3 are essentially the same in the method of attaching the exterior wall members 2 that are vertically adjacent using the securing member 10, and therefore portions other than the portions that differ from each other will be described using the case of an exterior wall member 2 with the so-called two-side shiplap shape shown in FIG. 2.

As shown in FIG. 1, multiple exterior wall members 2 are first fixed at the lowermost position of the outer surface 8F of the building frame 8 in a state of being adjacent to each other in the left-right direction. At this time, the lowerside end portions 2D of the exterior wall members 2 are supported by lowerside supporting members 55 that are arranged at the lowermost end of the outer surface 8F of the building frame 8 and extend in the left-right direction. The exterior wall members 2 that are adjacent to each other in the left-right direction are a first exterior wall member 2A1 and a third exterior wall member 2A3.

As shown in FIGS. 2 to 4, a second exterior wall member 2A2 and a fourth exterior wall member 2A4 are fixed above the first exterior wall member 2A1 and the third exterior wall member 2A3 in a state of being adjacent to each other in the left-right direction. The method of performing fixing using the securing member 10 is similar for each exterior wall member 2.

The exterior wall members 2 are normally attached from the left side to the right side. For example, in FIGS. 2 and 3, as shown in the securing member 10L, if the left end on the upper side of the fourth exterior wall member 2A4 is to be fixed, the securing member 10L is placed on the lower tongue portion 22 provided on the upper side of the fourth exterior wall member 2A4. Specifically, the securing member 10L is placed with the lower tongue portion 22 sandwiched between the lower engagement portions 12 (12L, 12C, 12R) and the contact surface 31 located below the support piece 13*a*.

Also, the left-side end-side fixing portion 17L is arranged so as to overlap with the support member 7*a*, and thus the right-side portion of the securing member 10L extends in a direction toward the center of the fourth exterior wall member 2A4.

A worker fixes the securing member 10L to the support member 7*a* using screws 5 via the fixing holes 17*h* of the end-side fixing portion 17L in this state. Accordingly, the left end on the upper side of the fourth exterior wall member 2A4 is fixed.

If the left-side end-side fixing portion 17L is used, normally the central fixing portion 19 and the right-side end-side fixing portion 17R of the securing member 10L are not used.

Next, the central portion of the fourth exterior wall member 2A4 is fixed. As shown in the securing member 10C in FIGS. 2 and 3, the securing member 10C is placed on the lower tongue portion 22 of the fourth exterior wall member 2A4 at a position where the central fixing portion 19 of the securing member 10C overlaps with the support member 7*b*. Specifically the securing member 10C is placed with the lower tongue portion 22 sandwiched between the lower engagement portions 12 (12L, 12C, 12R) and the contact surface 31 below the support piece 13*a*. Accordingly the securing member 10C is arranged on the fourth exterior wall member 2A4.

A worker fixes the securing member 10C to the support member 7*b* using screws 5 via the fixing holes 19*h* of the central fixing portion 19 in this state. The portion other than the end portions of the fourth exterior wall member 2A4 is fixed by performing this task at a position corresponding to the support member 7*b* located at a position other than the two ends of the fourth exterior wall member 2A4.

If the central fixing portion 19 is used, normally, the left and right end-side fixing portions 17L and 17R of the securing member 10C are not used.

Note that in FIGS. 1 to 3, a configuration is used in which four support members 7*b* are arranged between the support members 7*a* on both ends of the fourth exterior wall member 2A4 (in FIGS. 2 and 3, only a portion thereof is shown). For this reason, on the upper side portion other than the end portions of the fourth exterior wall member 2A4, the securing members 10C are used at four locations at which the support members 7*b* are present. However, the locations at which the exterior wall member 2 is fixed other than the two end portions of the exterior wall member 2 are not limited to the four locations on the upper side of the exterior wall member 2. Depending on the size of the exterior wall members 2, the number of structural members, the height of the structural members, and the like, there may be cases where it is not necessary to perform fixing at portions other than the end portions of the exterior wall members 2, and there may be cases where fixing is performed at more than four locations.

Next, the right end on the upper side of the fourth exterior wall member 2A4 is fixed using the securing member 10R. In FIGS. 2 and 3, the right end of the fourth exterior wall member 2A4 is not shown, but instead, a state is shown in which the right end on the upper side of the second exterior wall member 2A2 is fixed by the securing member 10R.

If the right end on the upper side of the fourth exterior wall member 2A4 is to be fixed, it is laterally symmetrical to the case in which the left end on the upper side of the fourth exterior wall member 2A4 is fixed by the securing member 10L. That is, the securing member 10R is placed on the fourth exterior wall member 2A4 in a state of sandwiching the lower tongue portion 22 between the upper engagement portions 12 (12L, 12C, 12R) of the securing member 10R and the contact surface 31 below the support piece 13*a*.

At this time, the right-side end-side fixing portion 17R is arranged so as to overlap with the support member 7*a*, and the portion on the left side of the securing member 10R extends in the direction toward the center of the fourth exterior wall member 2A4.

A worker fixes the securing member 10R to the support member 7*a* using screws 5 via the fixing holes 17*h* of the end-side fixing portion 17R in this state. Accordingly the right end on the upper side of the fourth exterior wall member 2A4 is fixed.

If the right-side end-side fixing portion 17R is used, normally the central fixing portion 19 and the left-side end-side fixing portion 17L of the securing member 10R are not used.

Due to the above-described step, the fourth exterior wall member 2A4 is attached to the building frame 8. Thereafter, after the exterior wall member 2 to the upper left of the fourth exterior wall member 2A4 is attached, an exterior wall member 2 is attached above the fourth exterior wall member 2A4.

At this time, the exterior wall member 2 is attached on the securing members 10L, C, and R that have already been attached. Specifically, as shown in FIGS. 1, 2, and 4, the exterior wall member 2 is placed above the fourth exterior wall member 2A4 in a state in which the upper tongue engaging portion 23 of the exterior wall member 2 is sandwiched between the upper engagement portions 11 (11L, 11C, 11R) and the contact surfaces 31 about the support pieces 13*a* of the securing members 10.

By implementing this kind of task also for other exterior wall members 2, the exterior wall members 2 are attached to the securing members 10 fixed to the structural member and cover the outer surface 8F of the building frame 8 in a state of being adjacent in the horizontal direction and in the vertical direction.

[Operations and Effects]

As shown in FIG. 6, in the securing member 10 of the first embodiment, the left-right directions and lower sides of the end-side fixing portions 17 are surrounded by the contact surface 31 composed of the bulging portion 30, and therefore the strength near the end-side fixing portions 17 improves and the securing member 10 is less likely to deform.

Also, with this securing member 10, the length L1 in the left-right direction of the inner-side contact surfaces 31F is set to be longer than the length L2 of the end-side contact surfaces 31E, and therefore the range that is reinforced by the inner-side contact surfaces 31F is wider, and the strength of the securing member 10 improves. That is, the exterior wall member 2 can be stably supported by fixing the securing member 10 to a structural member such as a column 9 or a support member 7 using an end-side fixing portion 17 located on one side of the securing member 10, and supporting the exterior wall member 2 with the other side arranged toward the central direction of the exterior wall member 2.

The end-side contact surfaces 31E and the inner-side contact surfaces 31F are formed on the end-side bulging portions 30E and the inner-side bulging portions 30F, which are bulging portions 30 above the support piece 13*a*. The end-side contact surface 31E and the inner-side contact surface 31F are portions that come into contact with the rear surface of the exterior wall member 2. Above the support piece 13*a*, the surface area of the contact surface 31 including the end-side contact surface 31E and the inner-side contact surface 31F is set to be about 1.5 times the surface area of the end-side fixing portion 17 and the center fixing portion 19. In this manner, the surface area of the contact surface 31 is large, and therefore the area of contact with the rear surface of the lower-side end portion 2D of the exterior wall member 2 is greater and the lower-side end portion 2D of the exterior wall member 2 can be stably supported. Therefore, the attachment state of the exterior wall member 2 is stable.

On the left side with respect to the center line B-B' of the securing member 10, the length L1 in the left-right direction of the inner-side contact surface 31F is longer than the length L3 in the left-right direction of the lower engagement portion 12L arranged on the lower side of the inner-side contact surface 31F and the inner-side contact surface 31F is formed spanning over the extended line of the boundary (IX-IX') between the lower engagement portion 12L and the upper engagement portion 11C shown in FIG. 6, and the extended line of the boundary between the upper engagement portion 11L and the lower engagement portion 12L. Accordingly, the boundary between the lower engagement portion 12L and the upper engagement portion 11C and the boundary between the upper engagement portion 11L and the lower engagement portion 12L are reinforced by the inner-side contact surface 31F.

The relationship between the inner-side contact surface 31F, the lower engagement portion 12R, and the upper engagement portions 11R and 11C on the right side with respect to the center line B-B' of the securing member 10 is also similar to the description above.

In this manner, the inner-side contact surface 31F is formed spanning over the extended line of the boundary between the left and right lower engagement portions 12L and 12R and the upper engagement portion 11L, 11C, and 11R, and therefore the vicinity of the boundary portion between adjacent engagement portions is reinforced by the inner-side contact surface 31F and is not likely to deform.

Furthermore, the shape of the securing member 10 has a width in the left-right direction that is greater than the width in the up-down direction and has a laterally-elongated approximately rectangular shape, and therefore the locking portion 13 can be made longer in the left-right direction. That is, the surface areas of the upper engagement portion 11 and the lower engagement portion 12 engaging the upper tongue engaging portion 23 and the lower tongue portion 22 of the exterior wall members 2 can be increased and the attachment strength for fixing the exterior wall member 2 improves. Therefore, the exterior wall member 2 can be stably supported.

Also, when a load in the external direction is applied to the vertically joining portion of the exterior wall members 2 due to a load applied by a strong wind or the like, a load in the external direction is applied to the engagement portions of the securing member 10 engaging the exterior wall members 2.

That is, the load in the external direction is applied by the lower tongue portion 22 of the lower exterior wall member 2 to the lower engagement portions 12 of the securing member 10, and a load in the external direction is applied from the upper tongue engaging portion 23 of the upper exterior wall member 2 to the upper engagement portions 11.

The movement of the lower tongue portion 22 of the lower exterior wall member 2 in the external direction is suppressed by the upper tongue portion 21 of the upper exterior wall member 2 and the lower engagement portions 12 of the securing member 10. On the other hand, the movement of the upper tongue engaging portion 23 of the upper exterior wall member 2 in the external direction is suppressed by the upper engagement portions 11 of the securing member 10.

That is, the lower tongue portion 22 of the lower exterior wall members 2 applies a load in the external direction to the upper tongue portion 21 of the upper exterior wall member 2 and the lower engagement portions 12 of the securing member 10, and therefore the load in the external direction applied to the upper engagement portions 11 of the securing member 10 is greater than the load in the external direction applied to the lower engagement portions 12.

In the present embodiment, the surface area of the upper engagement portions 11 is approximately two times the surface area of the lower engagement portions 12, and therefore the attachment strength for fixing the upper tongue engaging portion 23 of the upper exterior wall member 2 is approximately two times the attachment strength for fixing the lower tongue portion 22 of the lower exterior wall member 2.

In this manner, the area of contact between the upper engagement portions 11 of the securing member 10 and the upper tongue engaging portion 23 of the upper exterior wall member 2 is made greater than the area of contact between the lower engagement portions 12 of the securing members 10 and the lower tongue portion 22 of the lower exterior wall member 2, whereby the stress applied to the upper engagement portions 11 and the lower engagement portions 12 can be made equal, and the exterior wall members 2 arranged vertically can be supported stably and with good balance.

Furthermore, when the left-side end portion 2L side of the upper exterior wall member 2 is fixed by the securing member 10, the end-side fixing portion 17L is fixed to the building frame 8. As described above, the load in the external direction applied due to the load such as strong wind is greater for the upper engagement portion 11 than the lower engagement portion 12. The upper engagement portions 11L and 11R are arranged on both ends in the left-right direction of the securing member 10, and the upper engagement portion 11L is the closest to the end-side fixing portion 17L, and therefore even if a large load according to which the upper engagement portion 11L deforms is applied, the upper engagement portion 11L is reinforced by the end-side bulging portion 30E and the inner-side bulging portion 30F that are adjacent to the end-side fixing portion 17L, and thus deformation is not likely to occur. In this manner, the exterior wall member 2 can be even more stably fixed by arranging the upper engagement portion 11L at the position that is the closest to the end-side fixing portion 17L.

The relationship between the upper engagement portion 11R and the end-side fixing portion 17R of the securing member 10(R) placed on the right-side end portion 2R of the exterior wall member 2 is similar to that described above.

In this manner, since the upper engagement portions 11L and 11R are arranged on both sides in the left-right direction of the locking portion 13 and are near the end-side fixing portions 17L and 17R, the securing member 10 is not likely to deform, and the exterior wall members 2 can be stably fixed.

Since this securing member 10 has a laterally symmetrical shape, if the left side of the exterior wall member 2 is fixed, the end-side fixing portion 17L is used, and if the right side of the exterior wall member 2 is fixed, the end-side fixing portion 17R is used, and thereby the securing member 10 is used for both left and right. Furthermore, the central fixing portion 19 is included also at the center in the left-right direction, and therefore the securing member 10 can be used not only for the end portions of the exterior wall members 2, but also for portions other than the end portions.

If the central fixing portion 19 is used to engage the intermediate region of the upper-side end portion 2U of the exterior wall member 2 or the intermediate region of the lower-side end portion 2D, the contact surface 31 is adjacent to the left-right direction and the lower side of the central fixing portion 19, and therefore the load applied by the exterior wall members 2 to the securing member 10 and a load such as wind pressure can be dispersed in the left-right direction of the securing member 10, and the exterior wall members 2 can be stably fixed.

Also, the opening 13*b* formed by cutting out a portion corresponding to the lower fixing piece 12C is included on the support piece 13*a* of the securing member 10. Rain water on the support piece 13*a* can be made less likely to remain due to the opening 13*b*, and thus deterioration of the exterior wall member 2 can be suppressed.

Note that there is no limit on the present embodiment as long as the opening 13*b* provided on the support piece 13*a* has a shape through which rain water on the support piece 13*a* can be discharged.

Second Embodiment

Figure 11:
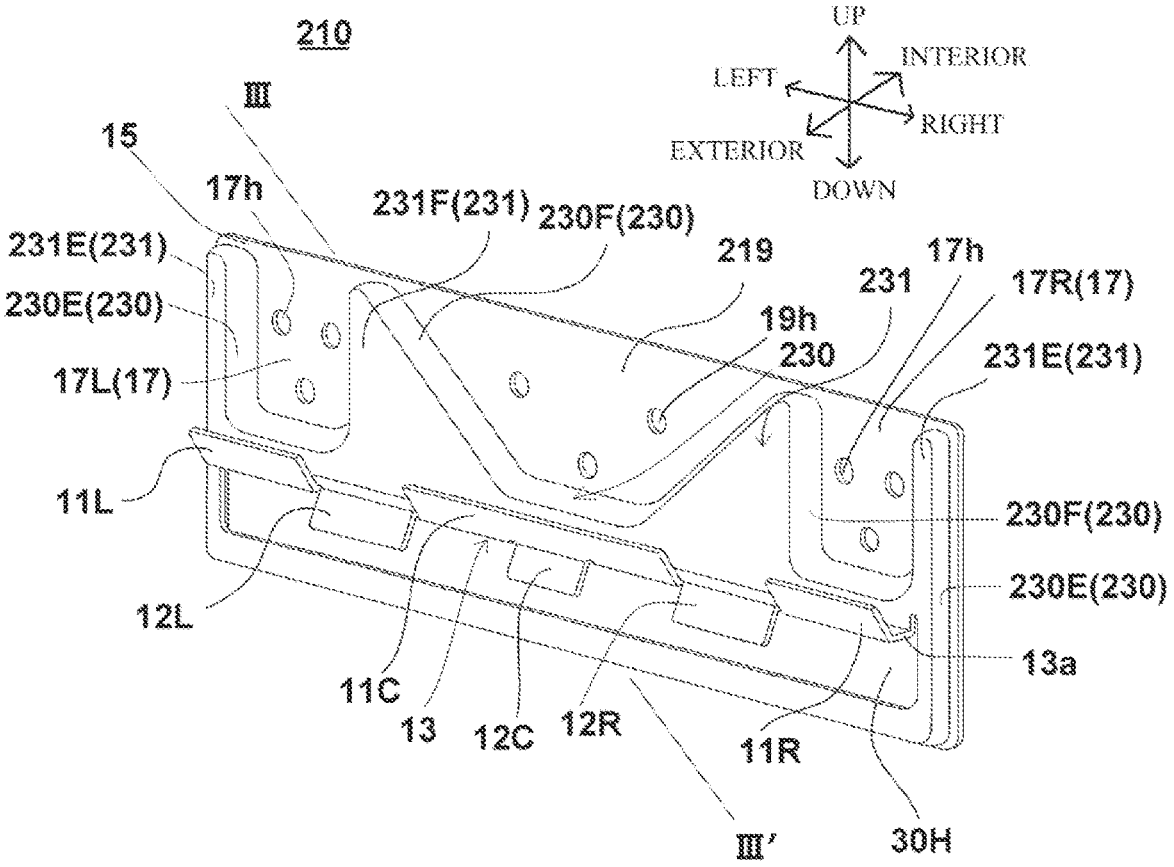
FIG. 11 is a perspective view schematically showing a securing member according to a second embodiment of the present invention.

FIG. 11 shows a securing member 210 of a second embodiment. The securing member 210 includes an inner-side bulging portions 230F in which the shape of the side portion on the central fixing portion 19 side of the inner-side bulging portion 30 of the securing member 10 of the first embodiment is inclined so as to widen toward the locking portion 13.

Regarding the configuration of the securing member 210, configurations that are the same as those of the securing member 10 of the first embodiment are denoted by the same reference numerals and description thereof is omitted.

As indicated by the line III-III', the shape of the left-side end-side bulging portion 230F is inclined such that the side portion on the adjacent central fixing portion 219 side increases toward the locking portion 13. Also, the lower engagement portion 12L and the upper engagement portion 11C of the locking portion 13 are arranged below the inclination (III-III') of the left-side inner-side bulging portion 230F with respect to the central line in the left-right direction of the locking portion 13. The inclination of the left-side inner-side bulging portion 230F is arranged spanning over the extended line of the boundary between the lower engagement portion 12L and the upper engagement portion 11C.

The same also applies to the relationship between the inner-side bulging portion 230F, the lower engagement portion 12R, and the upper engagement portion 11C arranged on the right side.

By giving the inner-side bulging portions 230F inclined shapes, the inner-side bulging portions 230F reinforce the vicinities of the boundaries between the adjacent engagement portions arranged below the inclinations due to having wide surface areas.

In the securing member 210, there is also an effect of dispersing a load concentrated near the above-described boundary in the up-down direction and the left-right direction due to the inclinations of the inner-side bulging portions 230F, and thus the securing member 210 is reinforced. Accordingly in addition to the effect of the securing member 10 of the first embodiment, the securing member 210 is even less likely to deform, and can stably fix the exterior wall members 2.

Third Embodiment

Figure 12:
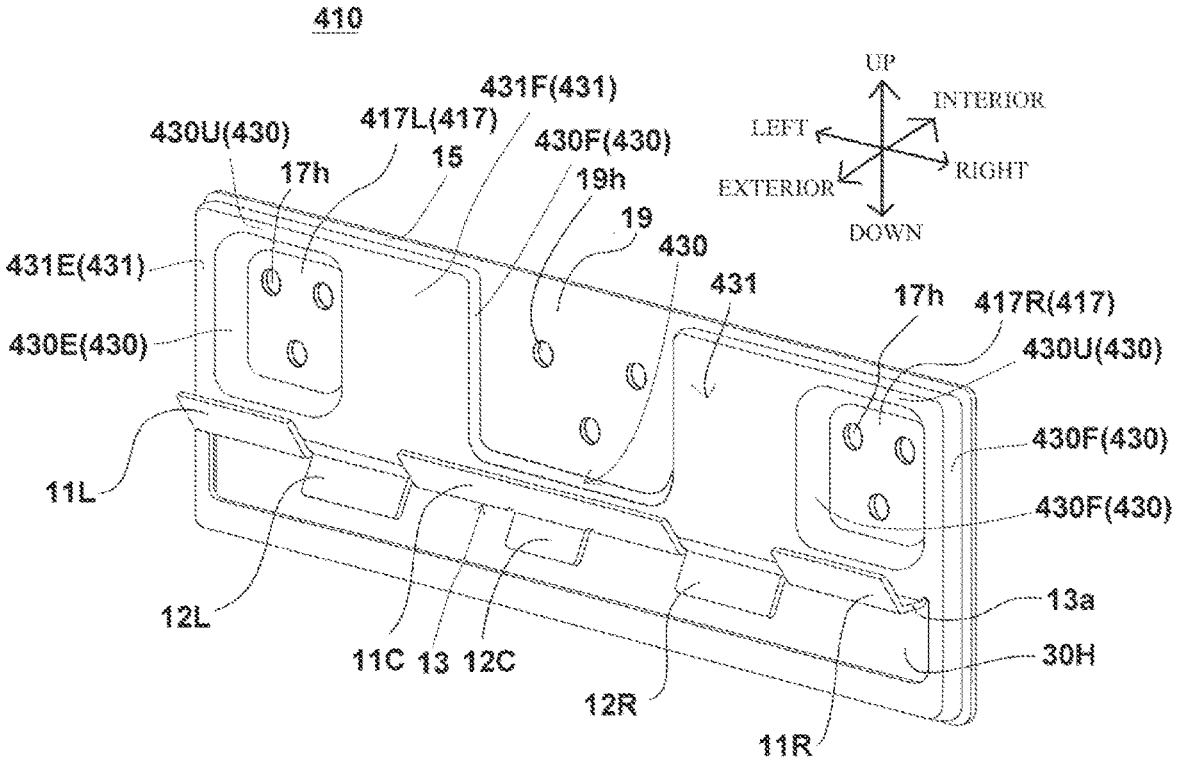
FIG. 12 is a perspective view schematically showing a securing member according to a third embodiment of the present invention.

FIG. 12 shows a securing member 410 of a third embodiment. In the securing member 410, upper bulging portions 430U that are adjacent to the upper sides of the end-side fixing portions 17 in the securing member 10 of the first embodiment are formed.

Regarding the configuration of the securing member 410, configurations that are the same as the securing member 10 of the first embodiment are denoted by the same reference numerals and description thereof is omitted.

Since the upper bulging portions 430U are formed on the securing member 410, the area of contact of the contact surface 431 that supports the rear surface of the exterior wall member 2 is expanded, and the exterior wall member 2 can be even more stably fixed.

Also, since the end-side fixing portions 417 are surrounded by the bulging portion 430, the strength near the end-side fixing portions 417 is further reinforced and deformation is less likely to occur. Accordingly, deformation and the like of the securing member 410 can be prevented as much as possible.

Furthermore, it is also preferable that an upper bulging portion 430U bulging outward from the substrate portion 15 is further provided also on the upper side of the central fixing portion 19 and the four sides of the central fixing portion 19 are surrounded by the bulging portion 430, although this is not shown in the drawings. In this case, the vicinity of the central fixing portion 19 is further reinforced by the bulging portion 430 adjacent to the four sides of the central fixing portion 19.

In this manner, due to the effect of the above-described upper bulging portions 430U and the effect of the first embodiment, the securing member 410 has large strength, and can even more stably fix the exterior wall members 2.

Fourth Embodiment

Figure 13:
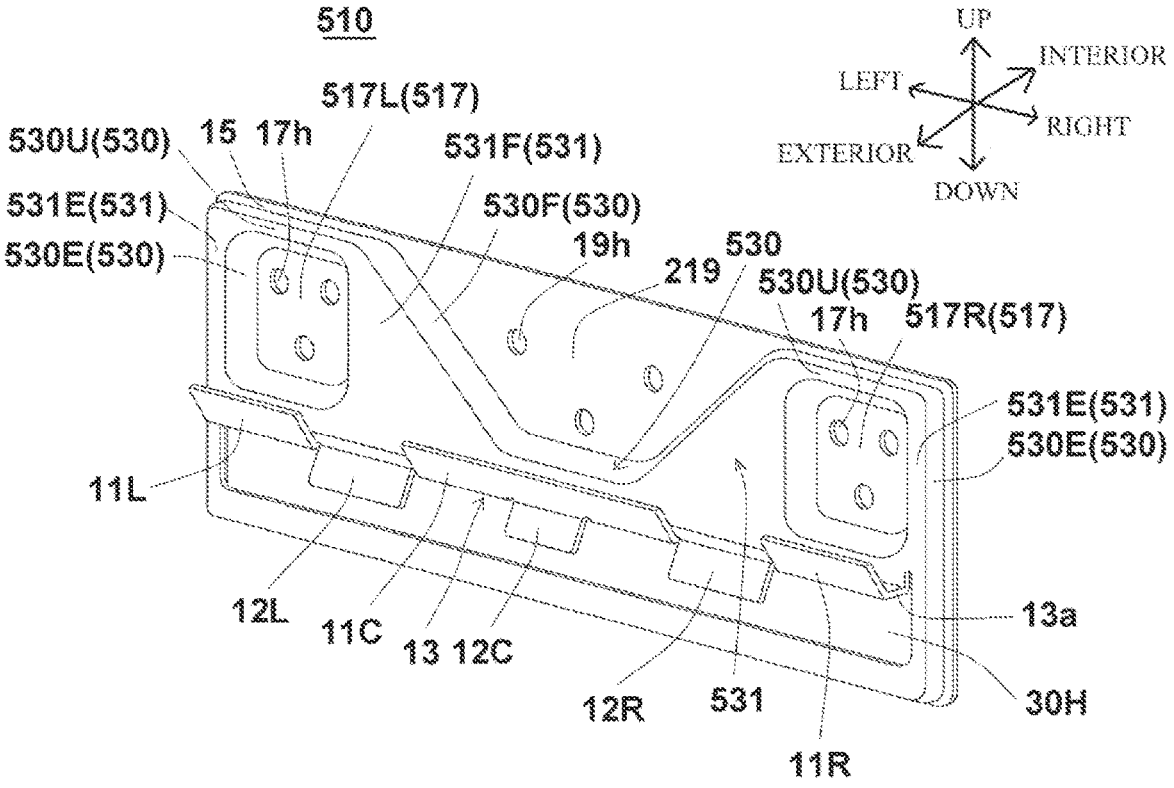
FIG. 13 is a perspective view schematically showing a securing member according to a fourth embodiment of the present invention.

FIG. 13 shows a securing member 510 of a fourth embodiment. In the securing member 510, upper bulging portions 530U that are adjacent to the upper sides of the end-side fixing portions 217 in the securing member 210 of the second embodiment are formed. That is, the securing member 510 of the fourth embodiment is obtained by providing the upper bulging portions 530U in the securing member 210 of the second embodiment, similarly to the securing member 410 of the third embodiment being obtained by providing the upper bulging portions 430U in the securing member 10 of the first embodiment.

Regarding the securing member 510 of the fourth embodiment, configurations that are the same as those of the second embodiment are denoted by the same reference numerals, and description thereof is omitted.

Since the upper bulging portions 530U are formed in the securing member 510, the area of contact of the contact surface 531 that supports the rear surface of the exterior wall member 2 is expanded, and the exterior wall member 2 can be even more stably fixed.

Also, since the four sides of each of the end-side fixing portions 517 are surrounded by the bulging portion 530, the strength near the end-side fixing portions 517 is further reinforced and deformation is not likely to occur.

Accordingly, deformation and the like of the securing member 510 can be prevented as much as possible.

Furthermore, it is also preferable that an upper bulging portion 530U bulging outward from the substrate portion 15 is further provided also on the upper side of the central fixing portion 219 and the four sides of the central fixing portion 219 are surrounded by the bulging portion 530, although this is not shown in the drawings. In this case, the vicinity of the central fixing portion 219 is further reinforced by the bulging portion 530 adjacent to the four sides of the central fixing portion 219.

In this manner, due to the effect of the above-described upper bulging portion 530U and the effect of the second embodiment, the securing member 510 has large strength, and can even more stably fix the exterior wall member 2.

Fifth Embodiment

Figure 14:
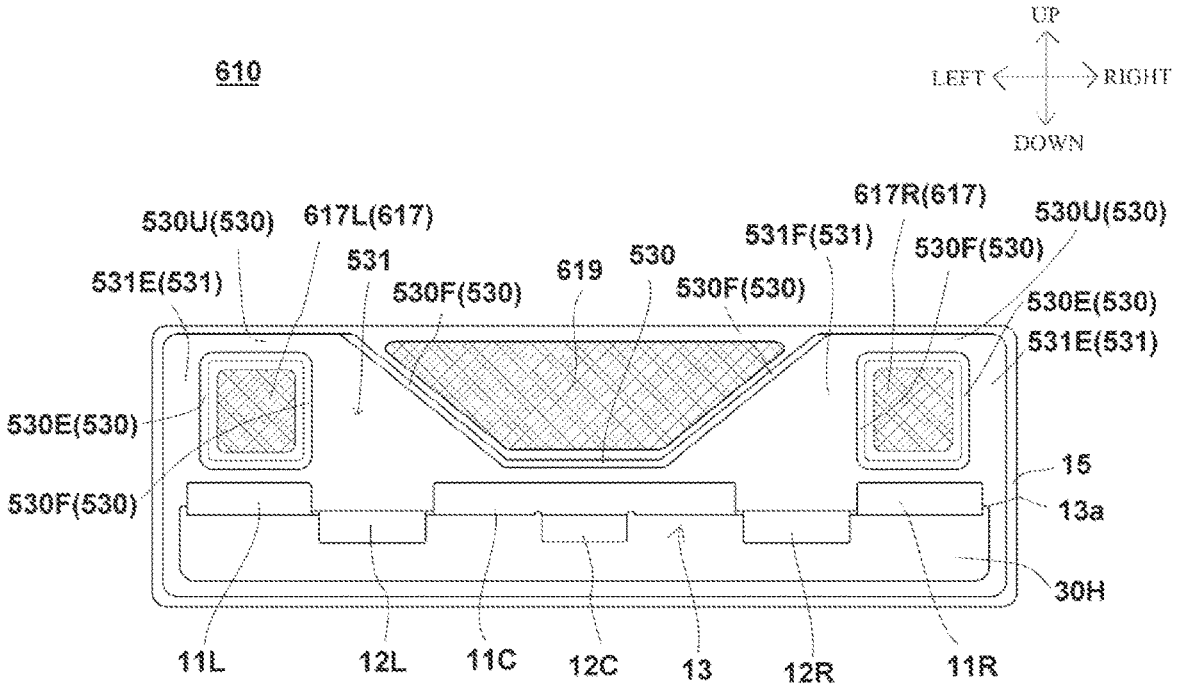
FIG. 14 is a front view schematically showing a securing member according to a fifth embodiment of the present invention.
Figure 15:
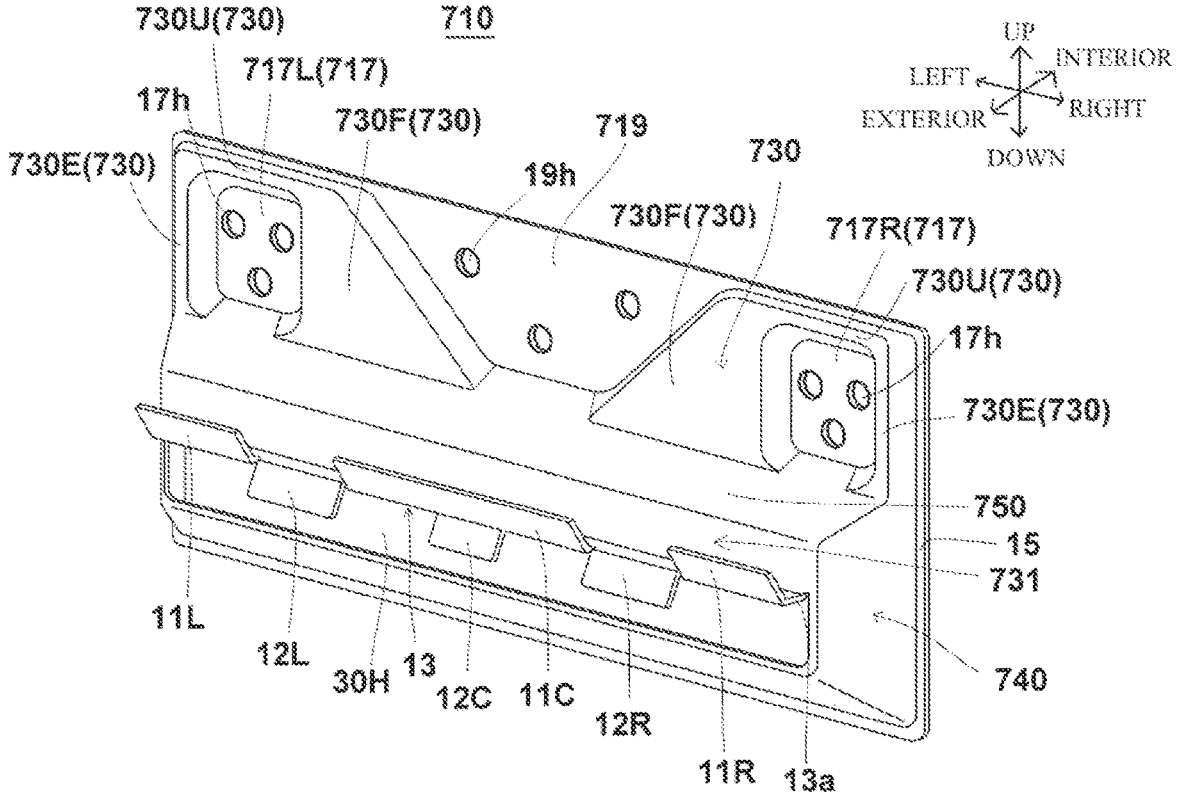
FIG. 15 is a perspective view schematically showing a securing member according to a sixth embodiment of the present invention.

FIG. 14 shows a securing member 610 of a fifth embodiment. The securing member 610 includes end-side fixing portions 617 and a central fixing portion 619 obtained by providing uneven surfaces on the end-side fixing portions 517 and the central fixing portion 519 of the securing member 510 of the fourth embodiment.

Regarding the securing member 610 of the fifth embodiment, configurations that are the same as those of the fourth embodiment are denoted by the same reference numerals, and description thereof is omitted.

In the securing member 610, the end-side fixing portions 617 and the central fixing portion 619 are not provided with the fixing holes 17*h* and 19*h*, and uneven surfaces are formed on the front surfaces thereof.

The unevenness on the front surfaces of the end-side fixing portions 617 and the central fixing portion 619 has a function of slip-resistance. Accordingly, the leading end of a fastener is not likely to slip when the securing member 610 is fixed to the support member 7 by a fastener such as a screw 5, and workability of attachment to the support member 7 improves.

Also, during construction, the fastener can be attached at any position of the uneven surface, and therefore when the securing member 610 is attached to the support member 7, the position of the securing member 610 is more easily adjusted with respect to the support member 7.

Furthermore, since there is no need to provide holes for a fastener in the end-side fixing portions 617 and the central fixing portion 619, it is possible to reduce the number of manufacturing steps, and workability improves.

In the securing member 610, compared with the securing member in which the holes for fastening are provided, there are no unused fixing holes 17*h* and 19*h*, and therefore the strength of the end-side fixing portion 617 and the central fixing portion 619 increases, and the strength of the securing member 610 is even further improved.

In order to provide the unevenness on the end-side fixing portions 617 and the central fixing portion 619, for example, it is preferable to use pressing, cutting, and the like to perform texturing, embossing, or the like.

Also, as the screw 5 for fastening or the like, a fastener having a drilling function is used like a known drill bit, whereby it is possible to perform a drilling task and an attachment task on the securing member 610 and the support member simultaneously, and therefore the constructability further improves.

Sixth Embodiment

FIGS. 15 to 18 show a securing member 710 of a sixth embodiment. The securing member 710 includes a pair of end-side fixing portions 717 (717L, 717R) that are arranged on both end portions in the left-right direction of the securing member 710. The first bulging portion 730 is arranged in the left-right directions and above the end-side fixing portions 717, and the second bulging portion 740 is arranged below.

Also, the central fixing portion 719 is arranged on the central portion in the left-right direction of the securing member 710, that is, on the center line E-E'. The first bulging portion 730 is arranged in the left-right direction of the central fixing portion 719, and the second bulging portion 740 is arranged below.

Regarding the securing member 710 of the sixth embodiment, configurations that are the same as those of the first to fifth embodiments are denoted by the same reference numerals, and description thereof is omitted.

The second bulging portion 740 is arranged on the lower side of the first bulging portion 730 of the securing member 710. A contact surface 731, which is a plane parallel to the reference surface 15S, is formed at the peak portion of the second bulging portion 740. The contact surface 731 is provided with the locking portion 13 that locks the exterior wall member 2.

The contact surface 731 smoothly connects the first bulging portion, the end-side fixing portions 717, and the central fixing portion 719, and the connection surface is a connection surface 750. The connection surface 750 is a bulging surface on the upper side of the second bulging portion 740.

Figure 16:
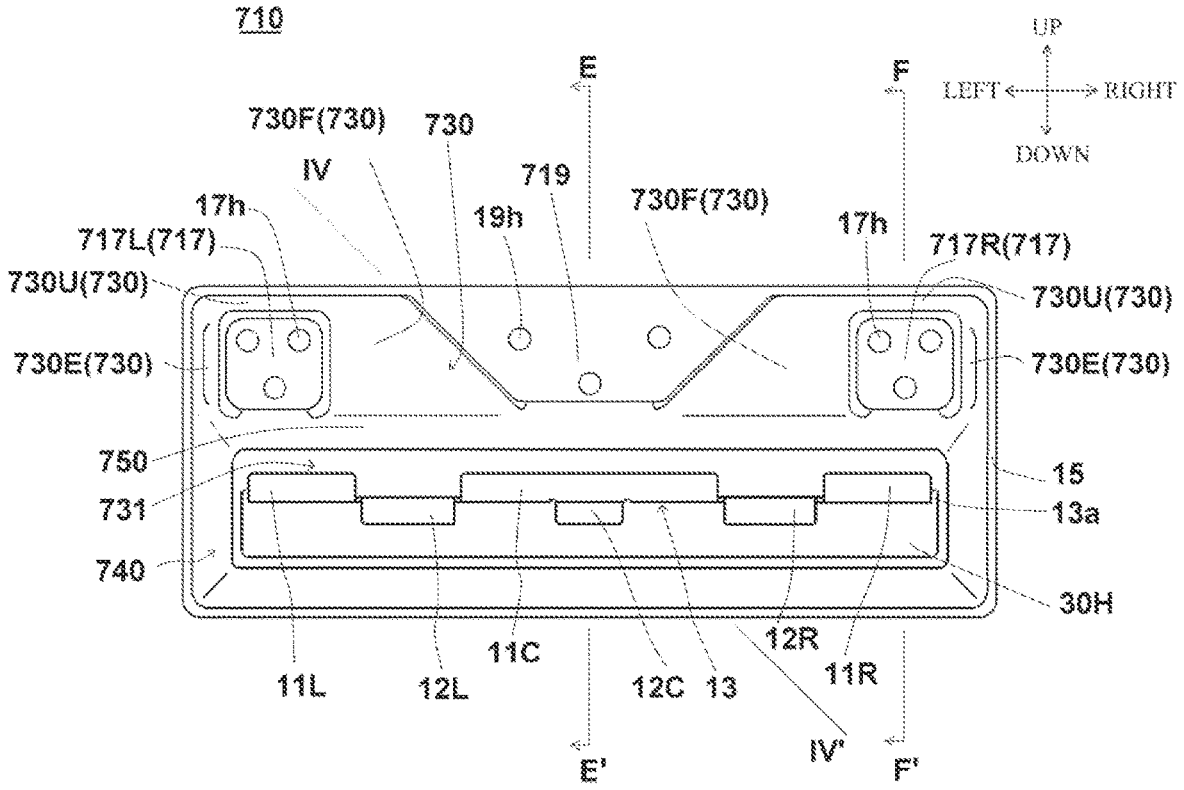
FIG. 16 is a front view schematically showing the securing member according to the sixth embodiment.
Figure 17:
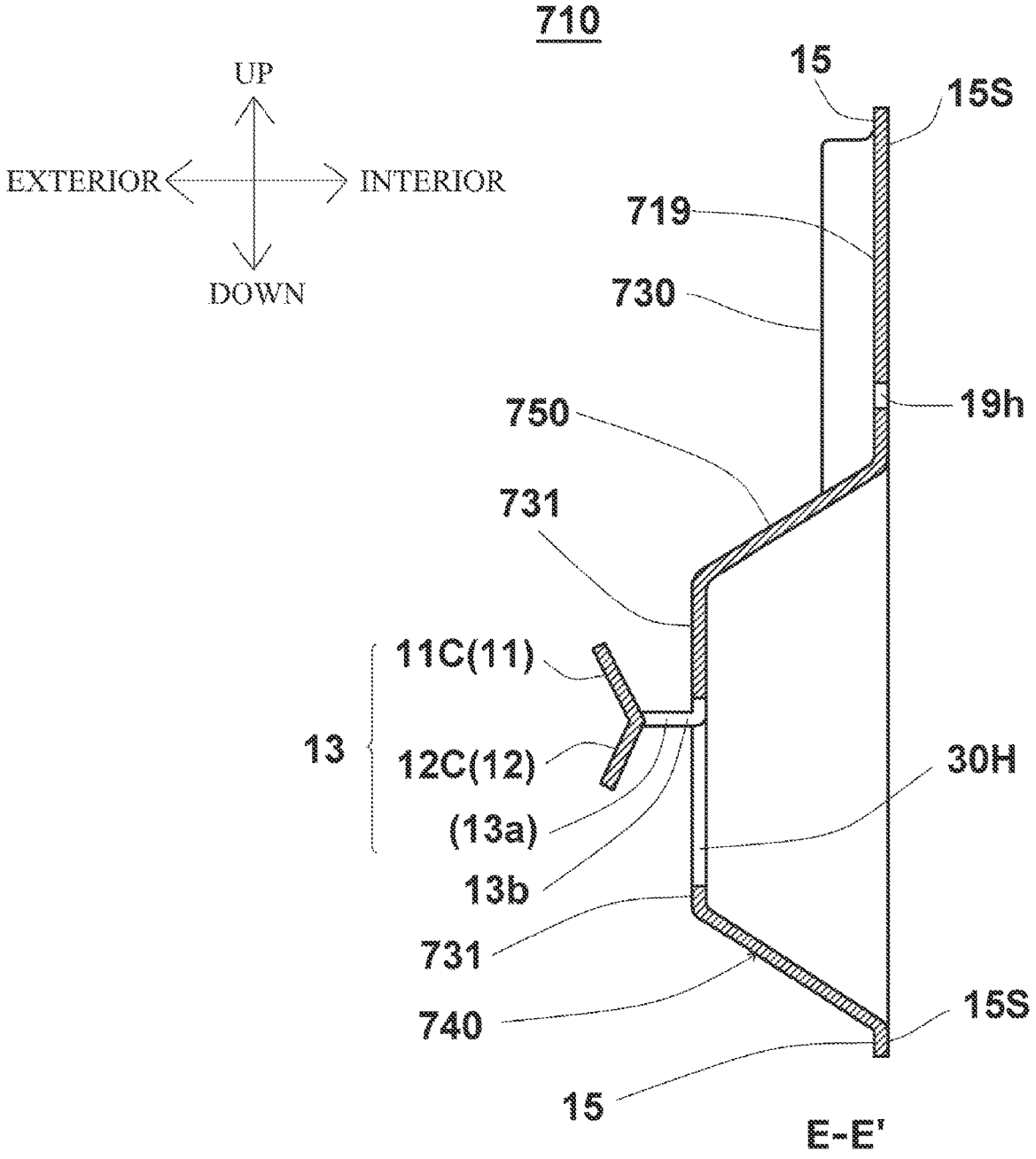
FIG. 17 is a cross-sectional view showing a cross section taken along line E-E' in FIG. 16.

As shown in FIG. 16, the end-side fixing portion 717L is a flat portion with an approximately quadrangular shape, provided at a position shifted to the left side with respect to the center line E-E'. The four sides of the end-side fixing portion 717L are surrounded by the first bulging portion 730 and the second bulging portion 740. Specifically, the upper side of the end-side fixing portion 717L is adjacent to the upper bulging portion 730U, the left side is adjacent to the end-side bulging portion 730E, the right side is adjacent to the inner-side bulging portion 730F, and the lower side is adjacent to the connection surface 750. The same also applies to the configurations of the end-side fixing portion 717R, the first bulging portion 730, and the second bulging portion 740 in the end-side fixing portion 717R, which is laterally symmetrical to the end-side fixing portion 717L with respect to the center line E-E'.

Also, the central fixing portion 719 is an approximately U-shaped flat portion provided on the center line E-E'. The central fixing portion 719 is adjacent to the pair of inner-side bulging portions 730F in the left-right direction of the securing member 710, and the lower side is adjacent to the connection surface 750.

The first bulging portion 730 includes the end-side bulging portions 730E on both ends in the left-right direction of the first bulging portion 730. Also, the first bulging portion 730 includes inner-side bulging portions 730F on the inner sides of the end-side bulging portions 730E, that is, on the center line E-E' sides. The side portions on the center line E-E' sides of the inner-side bulging portions 730F are inclined such that the widths in the left-right direction increase toward the locking portion 13.

Figure 18:
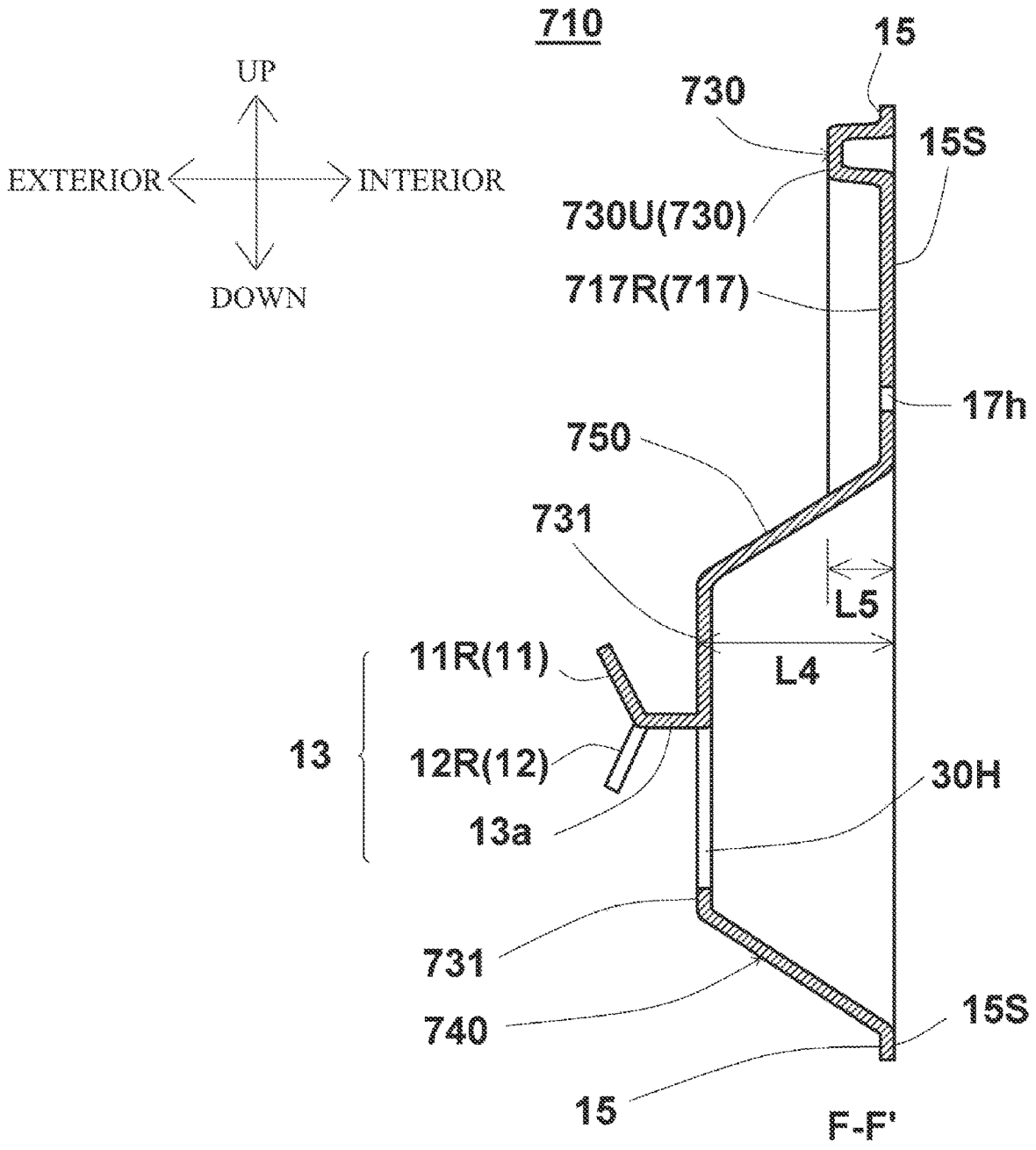
FIG. 18 is a cross-sectional view showing a cross section taken along line F-F in FIG. 16.

As shown in FIG. 18, the length L4 from the reference surface 15S to the contact surface 731 is longer than the length L5 from the reference surface 15S to the peak portion of the first bulging portion 730. That is, the second bulging portion 740 bulges toward the exterior with respect to the first bulging portion 730. In the present sixth embodiment, L4 is about 15 mm, L5 is about 5 mm, L4 is preferably about 12 mm to about 25 mm, and L5 is preferably about 3 mm to about 15 mm.

The four sides of the end-side fixing portion 717 are surrounded by the upper bulging portion 730U, the inner-side bulging portion 730F, the end-side bulging portion 730E, and the second bulging portion 740, and therefore the strength near the end-side fixing portion 717 is large and deformation is not likely to occur. Also, the central fixing portion 719 is surrounded in the left-right direction by the pair of inner-side bulging portions 730F and on the lower side by the second bulging portion 740, and therefore the strength near the central fixing portion 717 is large and deformation is not likely to occur.

Also, since the contact surface 731 is formed on the second bulging portion 740, the strength near the contact surface 731 is large and deformation is not likely to occur.

It is also preferable to further provide an upper bulging portion 730U that bulges outward from the substrate portion 15 on the upper side of the central fixing portion 719, although this is not shown in the drawings. Since the vicinity of the central fixing portion 719 is further reinforced by the upper bulging portion 730U, the securing member 710 is even less likely to deform.

Furthermore, in the constructed state, in the securing member 710, the length L4 corresponds to the distance from the rear surface of the exterior wall member 2 to the outer surface 8F of the building frame, or to the distance from the rear surface of the exterior wall member 2 to the front surface of the support member 7 attached to the outer surface 8F of the building frame. That is, in the securing member 710, the length L4 is long, and therefore there is sufficient length for forming a ventilation layer. That is, the securing member 710 can be used in a so-called ventilation fitting construction method in which the support members 7 are not arranged on the outer surface 8F of the building frame and the exterior wall members 2 are directly laid on the front surface 8F of the building frame. In this manner, with the securing member 710, the exterior wall member 2 can be directly laid on the structural member 8, and therefore there is no need to arrange the support members 7 and the constructability can be improved.

Also, since the connection surface 750 that is the upper surface of the second bulging portion 740 smoothly connects the first bulging portion 730 and the contact surface 731, when the upper exterior wall member 2 is engaged to the upper engagement portions 11 of the securing member 710, the lower-side end portion 2D of the exterior wall member 2 can be placed above the connection surface 750 of the securing member 710, can be moved over the connection surface 750 to the location of the upper engagement portion 11 of the securing member 710, and the upper tongue engaging portion 23 of the lower-side end portion 2D can be engaged with the upper engagement portions 11. At this time, the leading end of the upper tongue portion 21 of the lower-side end portion 2D of the upper exterior wall member 2 only comes into contact with the connection surface 750, and therefore it is possible to prevent the lower-side end portion 2D of the upper exterior wall member 2 from being damaged or chipped.

Seventh Embodiment

Figure 19:
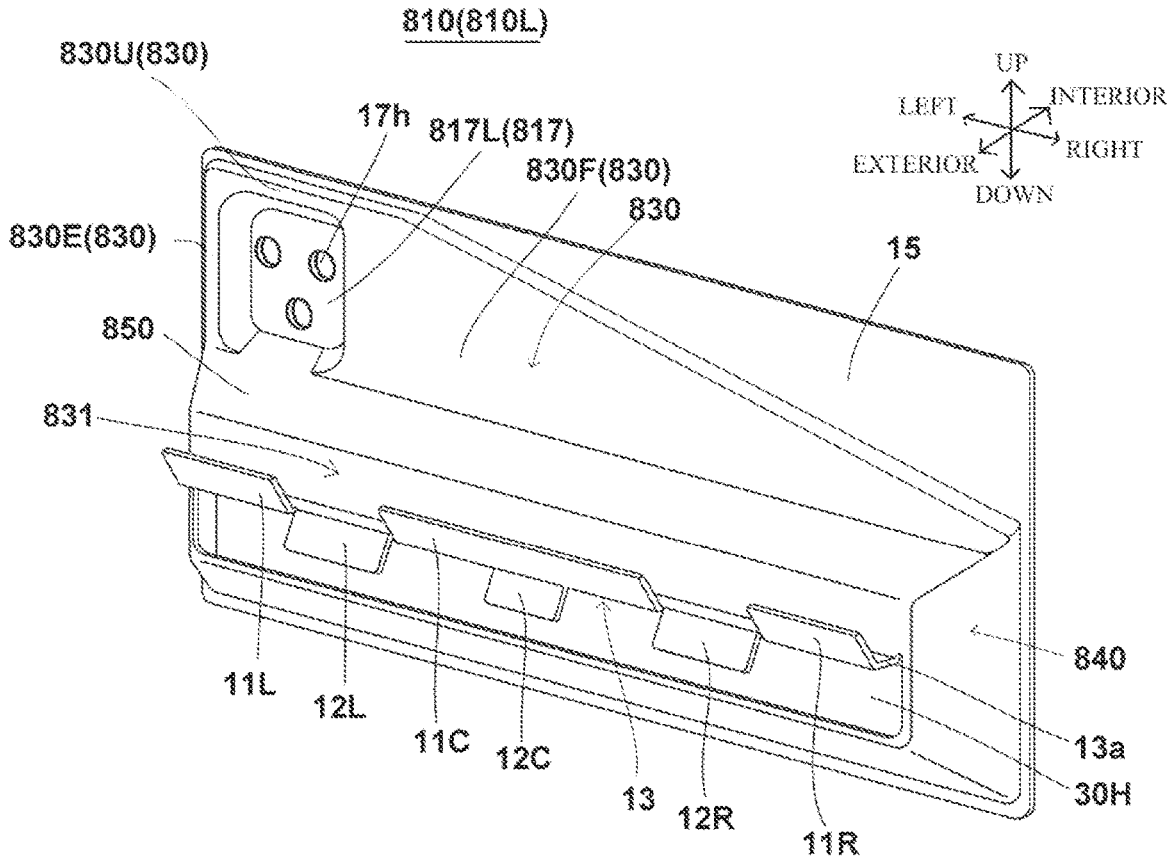
FIG. 19 is a perspective view schematically showing a securing member according to a seventh embodiment of the present invention.

FIG. 19 shows a securing member 810(L) of a seventh embodiment. In the securing member 810L, the shape of the portion corresponding to the first bulging portion 730 on the left side from the left-side inner-side bulging portion 730F in the securing member 710 of the sixth embodiment is the first bulging portion 830, and the second bulging portion 840 is provided below. Also, a contact surface 831 that is a planar surface parallel to the reference surface 15S is formed at a peak portion of the second bulging portion. Note that the configuration of the locking portion 13 formed on the second bulging portion 840 is the same. Also, in the present seventh embodiment, the fixing holes 19*h* of the central fixing portion 719 of the sixth embodiment are not provided. That is, the securing member 810L is a laterally-symmetrical shape having an end-side fixing portion 817L on the left side, and is used for fixing the end portion on the left-side end portion 2L side of the exterior wall member 2.

Regarding the securing member 810L of the seventh embodiment, configurations that are the same as those of the first to sixth embodiments are denoted by the same reference numerals, and description thereof is omitted.

The end-side fixing portion 817L of the securing member 810L is arranged at a position shifted to the left with respect to the center line in the left-right direction of the securing member 810L. The four sides of the end-side fixing portion 817L are surrounded by the first bulging portion 830 and the second bulging portion 840. Specifically, the left side of the end-side fixing portion 817L is adjacent to the end-side bulging portion 830E, the right side is adjacent to the inner-side bulging portion 830F, the upper side is adjacent to the upper bulging portion 830U, and the lower side is adjacent to the connection surface 850. The width in the left-right direction of the inner-side bulging portion 830F is inclined such that the side portion on the right side of the inner-side bulging portion 830F increases in width toward the locking portion 13. Also, the inclined end portion on the right side of the inner-side bulging portion 830F extends to the vicinity of the end portion on the right side of the securing member 810L.

Furthermore, the lower side of the first bulging portion 830 is adjacent to the second bulging portion 840. Also, the inner-side bulging portion 830F, the end-side bulging portion 830E, and the end-side fixing portion 817L connect smoothly to the contact surface 831. This connection surface is the connection surface 850.

In this manner, the four sides of the end-side fixing portion 817L are surrounded by the first bulging portion 830 and the second bulging portion 840, and therefore the strength near the end-side fixing portion 817L is large and deformation is not likely to occur. Also, the left-side side portion of the inner-side bulging portion 830F is adjacent to the end-side fixing portion 817L, the right-side side portion inclines so as to increase in width toward the locking portion 13, and the inclination extends to the vicinity of the right-side end portion of the securing member 810L. Therefore, a range of the securing member 810L that is wider than the wide surface area of the inner-side bulging portion 830F is reinforced, and therefore deformation is not likely to occur.

In this manner, the strength of the securing member 810L is large and deformation is not likely to occur, and therefore the exterior wall member 2 can be stably fixed.

The securing member 810L is used to fix the left-side end portion 2L side of the exterior wall member 2. On the other hand, if the right-side end portion 2R of the exterior wall member 2 is to be fixed, a securing member 810R that is laterally symmetrical to the securing member 810L is used, although this is not shown in the drawings.

When an intermediate portion other than the end portion of the exterior wall member 2 is to be fixed, the securing member 810L and the securing member 810R can also be used adjacent in the left-right direction such that the end-side fixing portions 817 are close to each other, and the securing member 710 of the sixth embodiment or a known securing member can also be used.

Note that in the seventh embodiment, since the second bulging portion 840 is formed, the peak portion of the first bulging portion 830 and the contact surface 831 are not the same surface. However, as shown in the first to fifth embodiments, the first bulging portion 830 and the second bulging portion 840 can also have the same height. In this case, the heights of the peak portion and the contact surface 831 of the first bulging portion 830 from the reference surface 15S are equal, and the surface area of the contact surface 831 is wider, and therefore the exterior wall member 2 can be even more stably fixed.

Although embodiments of the present invention were described above, the present invention is not limited to the embodiments. That is, it is to be understood that appropriate modifications and additions to the following embodiments performed based on normal knowledge of a person skilled in the art also belong in the scope of the present invention, without departing from the gist of the present invention.

LIST OF REFERENCE NUMERALS

2 Exterior wall member
2D Lower-side end portion of exterior wall member
2F Front surface of exterior wall member
2U Upper-side end portion of exterior wall member
2L Left-side end portion of exterior wall member
2R Right-side end portion of exterior wall member
2A1 First exterior wall member
2A2 Second exterior wall member
2A3 Third exterior wall member
2A4 Fourth exterior wall member
5 Screw

6 Waterproof sheet
7, 7*a*, 7*b* Support member
8 Building frame
8F Outer surface of building frame
9 Column member
9A Hat joiner
9B Joint filler
10, 10R, 10L, 10C, 210, 410, 510, 610, 710, 810, 810L Securing member
11, 11L, 11C, 11R Upper engagement portion
12, 12L, 12C, 12R Lower engagement portion
13*a* Support piece
13*b* Opening
13 Locking portion
15 Substrate portion
15S Reference surface of substrate portion
17*h*, 19*h* Fixing hole
17, 17L, 17R, 417, 417L, 417R, 517, 517L, 517R, 617, 617L, 617R, 717,
717L, 717R, 817, 817L End-side fixing portion
19, 219, 619, 719 Central fixing portion
21 Upper tongue portion
22 Lower tongue portion
23 Upper tongue engaging portion
30, 230, 430, 530 Bulging portion
730, 830 First bulging portion
740, 840 Second bulging portion
30H Opening
30E, 230E, 430E, 530E, 730E, 830E End-side bulging portion
30F, 230F, 430F, 530F, 730F, 830F Inner-side bulging portion
430U, 530U, 730U, 830U Upper bulging portion
750, 850 Connection surface
31, 231, 431, 531, 731, 831 Contact surface
31E, 231E, 431E, 531E End-side contact surface
31F, 231F, 431F, 531F Inner-side contact surface
55 Lower-end support member
66 Foundation

The invention claimed is:

1. A securing member for attaching a wall material to a building frame of a building, comprising:

a substrate portion;

a bulging portion that bulges from the substrate portion in a direction from a rear surface to a front surface of the substrate portion and extends in a longitudinal direction;

a locking portion that extends in the longitudinal direction of the securing member and protrudes from the bulging portion in a direction from the rear surface to the front surface of the substrate portion;

an end-side fixing portion that is provided at a position biased toward one end from a center of the locking portion in the longitudinal direction, and in which both sides in the longitudinal direction, a locking portion side, and an upper side are surrounded by the bulging portion;

an inner-side bulging portion that forms a portion of the bulging portion surrounding the end-side fixing portion, includes an inner-side contact surface for coming into contact with the wall material, and is located on a side toward the center of the locking portion in the longitudinal direction with respect to the end-side fixing portion;

an upper bulging portion that forms a portion of the bulging portion surrounding the end-side fixing portion; and an end-side bulging portion that forms a portion of the bulging portion surrounding the end-side fixing portion, includes an end-side contact surface for coming into contact with the wall material, and is located on a side opposite to the inner-side bulging portion in the longitudinal direction with respect to the end-side fixing portion, wherein a width in the longitudinal direction of the inner-side contact surface is greater than a width in the longitudinal direction of the end-side contact surface, wherein the end-side contact surface is located at one side of the end-side fixing portion, and the inner-side contact surface is located between the end-side fixing portion and a central fixing portion, wherein the end-side fixing portion has an area smaller than an area of the central fixing portion.

2. The securing member according to claim 1, wherein in the shape of the inner-side bulging portion, a side portion on a side opposite to the side adjacent to the end-side fixing portion is inclined such that the width in the longitudinal direction of the inner-side contact surface increases toward the locking portion.

3. The securing member according to claim 1, wherein the central fixing portion is provided at a position adjacent to the inner-side bulging portion in the longitudinal direction.

4. The securing member according to claim 3, wherein an uneven surface is included on a front surface of at least one of the end-side fixing portion and the central fixing portion.

5. The securing member according to claim 1, wherein the upper bulging portion is adjacent to the end-side fixing portion and is provided above the end-side fixing portion.

6. The securing member according to claim 1, further comprising:

a support piece that is provided on the locking portion and extends in a direction from the rear surface to the front surface of the substrate portion;

an upper engagement portion that is provided on the locking portion and extends in a direction away from the bulging portion on a leading end of the support piece on the end-side fixing portion side with respect to the support piece; and a lower engagement portion that is provided on the locking portion and extends in a direction away from the bulging portion on a leading end of the support piece on a side opposite to the end-side fixing portion side with respect to the support piece.

7. The securing member according to claim 6, wherein the upper engagement portion is arranged on both sides in the longitudinal direction of the locking portion.

8. The securing member according to claim 6, wherein an end portion of the inner-side bulging portion on the side opposite to the end-side fixing portion in the longitudinal direction is not at a position that matches in the longitudinal direction with a boundary between the upper engagement portion and the lower engagement portion that are the closest to the end portion.

9. A securing member for attaching a wall material to a building frame of a building, comprising:

a substrate portion;

a bulging portion that bulges from the substrate portion in a direction from a rear surface to a front surface of the substrate portion and extends in a longitudinal direction;

a contact surface that is provided on the bulging portion and that is configured to come into contact with the wall material;

a locking portion that extends in the longitudinal direction of the securing member and protrudes from the bulging portion in a direction from the rear surface to the front surface of the substrate portion;

an end-side fixing portion that is provided at a position biased toward one end side from a center of the locking portion in the longitudinal direction, and in which both sides in the longitudinal direction, a locking portion side, and an upper side are surrounded by the bulging portion;

a central fixing portion that is spaced apart from the end-side fixing portion, wherein the central fixing portion has a shape different from a shape of the end-side fixing portion;

an inner-side bulging portion that forms a portion of the bulging portion surrounding the end-side fixing portion, and is located on a side toward the center of the locking portion in the longitudinal direction with respect to the end-side fixing portion;

an upper bulging portion that forms a portion of the bulging portion surrounding the end-side fixing portion; and an end-side bulging portion that forms a portion of the bulging portion surrounding the end-side fixing portion and is located on a side opposite to the inner-side bulging portion in the longitudinal direction with respect to the end-side fixing portion, wherein in the longitudinal direction, a width of the inner-side bulging portion is greater than a width of the end-side bulging portion, in the inner-side bulging portion, a side portion on a side opposite to a side adjacent to the end-side fixing portion is inclined such that the width in the longitudinal direction of the inner-side bulging portion increases toward the locking portion, a length from the substrate portion to the contact surface is longer than a length from the substrate portion to a peak portion of the inner-side bulging portion, and the securing member includes a connection surface that connects a side portion on a locking portion side of the inner-side bulging portion and a side portion on the inner-side bulging portion side of the contact surface.

10. The securing member according to claim 9, wherein the central fixing portion is provided at a position adjacent to the inner-side bulging portion in the longitudinal direction.

11. The securing member according claim 9, wherein the upper bulging portion is adjacent to the end-side fixing portion and is provided above the end-side fixing portion.

12. The securing member according to claim 9, further comprising:

a support piece that is provided on the locking portion and extends in a direction from the rear surface to the front surface of the substrate portion;

an upper engagement portion that is provided on the locking portion and extends in a direction away from the bulging portion on a leading end of the support piece on the end-side fixing portion side with respect to the support piece; and a lower engagement portion that is provided on the locking portion and extends in a direction away from the bulging portion on a leading end of the support piece on a side opposite to the end-side fixing portion side with respect to the support piece.

13. The securing member according to claim 12, wherein the upper engagement portion is arranged on both sides in the longitudinal direction of the locking portion.

14. The securing member according to claim 12, wherein an end portion of the inner-side bulging portion on the side opposite to the end-side fixing portion in the longitudinal direction is not at a position that matches in the longitudinal direction with a boundary between the upper engagement portion and the lower engagement portion that are the closest to the end portion.

15. The securing member according to claim 10, wherein an uneven surface is included on a front surface of at least one of the end-side fixing portion and the central fixing portion.

16. A wall structure comprising:

a building frame of a building;

a plurality of wall materials; and a securing member for attaching the wall materials to the building frame, wherein the securing member includes a substrate portion, a bulging portion that bulges from the substrate portion in a direction from a rear surface to a front surface of the substrate portion and extends in a longitudinal direction of the securing member, a contact surface that is provided on the bulging portion and is for coming into contact with a rear surface of the wall material, a locking portion that extends in the longitudinal direction of the securing member and protrudes from the bulging portion in a direction from the rear surface to the front surface of the substrate portion, end-side fixing portions that are provided at positions biased toward ends from a center of the locking portion in the longitudinal direction, and in which both sides in the longitudinal direction, and a locking portion side, and an upper side are surrounded by the bulging portion, a central fixing portion that is provided at a position disposed between the end-side fixing portions, wherein the central fixing portion has a shape different from a shape of the end-side fixing portions, an inner-side bulging portion that forms a portion of the bulging portion, is located on a side toward the center of the locking portion in the longitudinal direction with respect to the end-side fixing portion, and has a shape in which a side opposite to a side adjacent to the end-side fixing portion is inclined toward the locking portion in a substantially straight line such that width in the longitudinal direction increases toward the locking portion, an upper bulging portion that forms a portion of the bulging portion surrounding each of the end-side fixing portions, and one end side of the securing member is fixed to the building frame at the end-side fixing portion, and another end side supports the wall material using the locking portion in a state of not being fixed to the building frame.

* * * * *